US009719699B2

(12) United States Patent
Tamura et al.

(10) Patent No.: US 9,719,699 B2
(45) Date of Patent: Aug. 1, 2017

(54) REFRIGERATION DEVICE

(75) Inventors: Tomoichiro Tamura, Osaka (JP); Kou Komori, Nara (JP); Bunki Kawano, Osaka (JP); Hidetoshi Taguchi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 687 days.

(21) Appl. No.: 14/114,417

(22) PCT Filed: Apr. 27, 2012

(86) PCT No.: PCT/JP2012/002933

§ 371 (c)(1),
(2), (4) Date: Oct. 28, 2013

(87) PCT Pub. No.: WO2012/147367

PCT Pub. Date: Nov. 1, 2012

(65) Prior Publication Data

US 2014/0047862 A1 Feb. 20, 2014

(30) Foreign Application Priority Data

Apr. 28, 2011 (JP) ..... 2011-101220
Apr. 28, 2011 (JP) ..... 2011-101224

(51) Int. Cl.
*F25B 1/10* (2006.01)
*F25B 13/00* (2006.01)
*F25B 41/00* (2006.01)

(52) U.S. Cl.
CPC ..... *F25B 1/10* (2013.01); *F25B 13/00* (2013.01); *F25B 41/00* (2013.01);
(Continued)

(58) Field of Classification Search
CPC ..... B67D 3/0009; B67D 3/0061; B67D 2001/0814; F25B 7/00; F25B 1/10;
(Continued)

(56) References Cited

U.S. PATENT DOCUMENTS 2,235,071 A * 3/1941 Gonzalez ..... F25B 1/10 62/117
2,680,956 A * 6/1954 Haas ..... F25B 7/00 62/175

(Continued)

FOREIGN PATENT DOCUMENTS

CN 102016449 4/2011
JP 62-284154 12/1987

(Continued)

OTHER PUBLICATIONS

Search Report issued in Chinese Application No. 201280020060.9 on Feb. 28, 2015 with an English translation.

*Primary Examiner* — Len Tran
*Assistant Examiner* — Kirstin Oswald
(74) *Attorney, Agent, or Firm* — Hamre, Schumann, Mueller & Larson, P.C.

(57) ABSTRACT

An air conditioner (1A) as a refrigeration apparatus includes: a refrigerant circuit (2) including an evaporator (25), a first compressor (21), a vapor cooler (3), a second compressor (22), and a condenser (23) that are connected in this order; a heat release circuit (4) that allows a heat medium to circulate between the condenser (23) and a first heat exchanger (5) that releases heat to the atmosphere; and a heat absorption circuit (6) that allows a heat medium to circulate between the evaporator (25) and a second heat exchanger (7). The vapor cooler (3) is a heat exchanger that exchanges heat between a refrigerant vapor compressed by the first compressor (21) and the heat medium flowing in the
(Continued)

heat release circuit (4) or the heat medium flowing in the heat absorption circuit (6).

5 Claims, 16 Drawing Sheets

(52) U.S. Cl.
CPC . *F25B 2313/02742* (2013.01); *F25B 2400/04* (2013.01); *F25B 2400/072* (2013.01); *F25B 2400/13* (2013.01); *F25B 2400/16* (2013.01)

(58) Field of Classification Search
CPC .... F25B 41/00; F25B 2400/13; F25B 31/002; F25B 2321/02; F25B 13/00
USPC ..... 62/510, 513, 175, 498, 503, 509, 512
See application file for complete search history.

(56) References Cited

U.S. PATENT DOCUMENTS 3,392,541 A * 7/1968 Nussbaum ..... F25B 7/00 62/175
3,534,564 A * 10/1970 Miller ..... F25B 1/10 62/192
3,984,050 A * 10/1976 Gustafsson ..... F24D 3/18 237/2 B
4,251,247 A * 2/1981 Gauberthier ..... F25J 1/0022 62/114
4,323,109 A * 4/1982 Jaster ..... B01D 1/2809 165/45
4,372,129 A * 2/1983 Bennett ..... F25B 49/005 62/175
4,896,515 A 1/1990 Endou
5,335,508 A * 8/1994 Tippmann ..... F25B 7/00 62/129
2011/0036110 A1 2/2011 Fujimoto et al.
2011/0197611 A1* 8/2011 Hall ..... B60H 1/00378 62/238.7

FOREIGN PATENT DOCUMENTS

| | | |
|---|---|---|
| JP | 6-257890 | 9/1994 |
| JP | 8-061795 | 3/1996 |
| JP | 2002-106988 | 4/2002 |
| JP | 2003-065582 | 3/2003 |
| JP | 2003-065585 | 3/2003 |
| JP | 2004-257611 | 9/2004 |
| JP | 2006-017426 | 1/2006 |
| JP | 2007-120914 | 5/2007 |
| JP | 2008-122012 | 5/2008 |
| JP | 2008-275288 | 11/2008 |
| JP | 2010-112618 | 5/2010 |
| JP | 2010-271030 | 12/2010 |
| JP | 2011-069599 | 4/2011 |
| WO | 2009/121548 | 10/2009 |

* cited by examiner

REFRIGERATION DEVICE

TECHNICAL FIELD

The present invention relates to a refrigeration apparatus.

BACKGROUND ART

Conventionally, refrigeration apparatuses such as air conditioners, in which chlorofluorocarbon or an alternative for chlorofluorocarbon is used as a refrigerant, are widely used. However, these refrigerants are responsible for the problems such as ozone depletion and global warming. In view of these, air conditioners have been proposed in which water is used as a refrigerant having a very low impact on the global environment. As an example of such an air conditioner, Patent Literature 1 discloses an air conditioner designed specifically for cooling a room.

When water is used as a refrigerant, a large amount of refrigerant vapor needs to be compressed at a high compression ratio. Accordingly, the air conditioner disclosed in Patent Literature 1 includes two compressors, i.e., a centrifugal compressor and a positive displacement compressor, and these compressors are arranged in series so that a refrigerant vapor compressed by the centrifugal compressor is further compressed by the positive displacement compressor.

In addition, when water is used as a refrigerant, the temperature of the refrigerant discharged from a compressor is high due to the physical properties of water. Therefore, the durability of members constituting a high-pressure part of an air conditioner decreases. In order to address this problem, it is effective to dispose a vapor cooler between the upstream-side compressor and the downstream-side compressor as in the air conditioner disclosed in Patent Literature 1, so as to temporarily lower the temperature of the refrigerant vapor in the course of the compression process.

CITATION LIST

Patent Literature

Patent Literature 1: JP 2008-122012 A

SUMMARY OF INVENTION

Technical Problem

The air conditioner disclosed in Patent Literature 1 is designed specifically for cooling a room, but it may be possible to use this air conditioner for heating a room. However, in that case, heat released from the refrigerant vapor in the vapor cooler results in heat loss, which reduces the heating capacity. This means that the COP (coefficient of performance) of the air conditioner decreases.

In view of the above circumstances, it is an object of the present invention to improve the COP of a refrigeration apparatus in heating operation.

Solution to Problem

In order to achieve the above object, a first aspect of the present disclosure provides a refrigeration apparatus including: a refrigerant circuit that allows a refrigerant to circulate, the refrigerant circuit including an evaporator that retains a refrigerant liquid and that evaporates the refrigerant liquid therein, a first compressor that compresses a refrigerant vapor, a vapor cooler that cools the refrigerant vapor, a second compressor that compresses the refrigerant vapor, and a condenser that condenses the refrigerant vapor therein and that retains the refrigerant liquid, wherein the evaporator, the first compressor, the vapor cooler, the second compressor, and the condenser are connected in this order; a heat release circuit that allows a heat medium to circulate between the condenser and a first heat exchanger that releases heat to the atmosphere; and a heat absorption circuit that allows a heat medium to circulate between the evaporator and a second heat exchanger, wherein the vapor cooler is a heat exchanger that exchanges heat between the refrigerant vapor compressed by the first compressor and the heat medium flowing in the heat release circuit or the heat medium flowing in the heat absorption circuit.

Advantageous Effects of Invention

According to the refrigeration apparatus described above, since heat is released from the first heat exchanger to the atmosphere, heating can be performed. In addition, the heat released from the refrigerant vapor in the vapor cooler can be recovered by the heat medium. Therefore, the heat loss in heating operation is significantly reduced. Thereby, the COP of the refrigeration apparatus can be improved. Furthermore, according to the refrigeration apparatus described above, a secondary cooling system for cooling the refrigerant vapor can be omitted. This advantage can also be obtained when the refrigeration apparatus is used for cooling.

DESCRIPTION OF EMBODIMENTS

Figure 1:
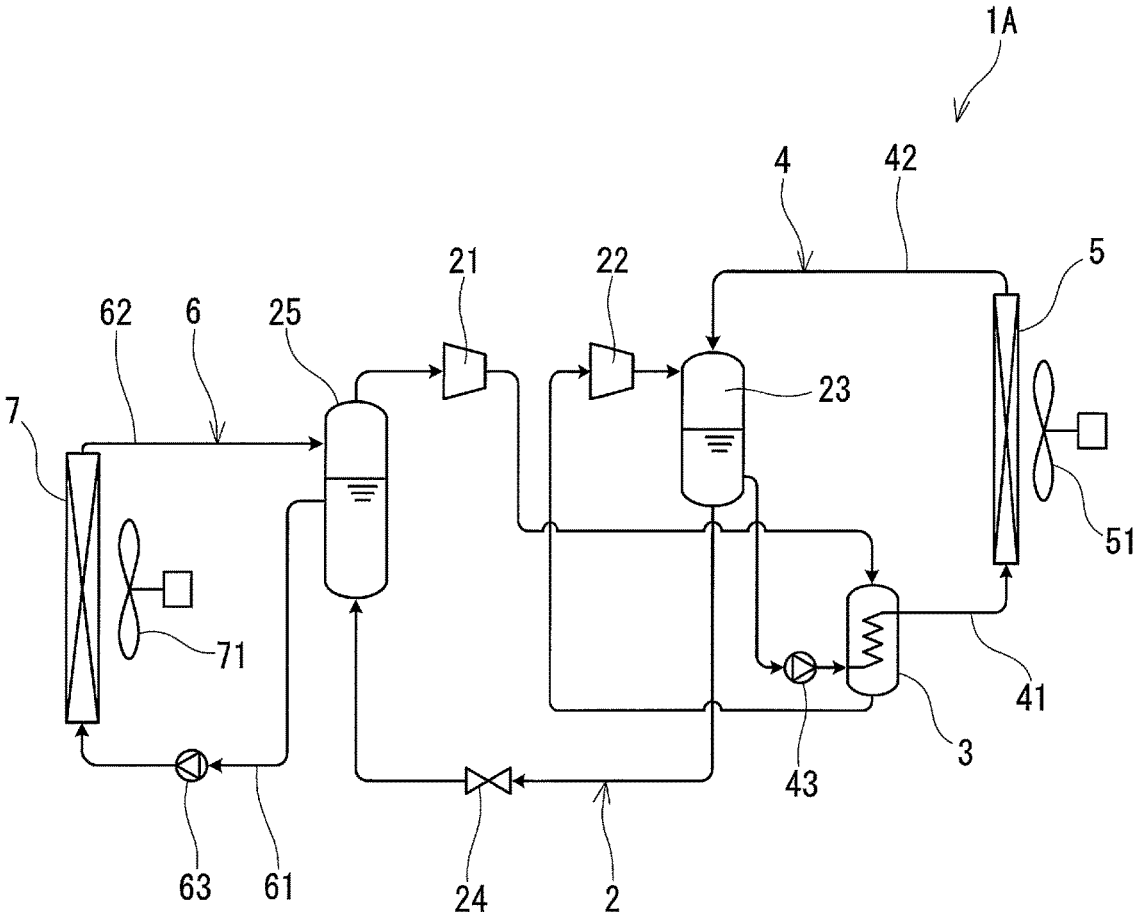
FIG. 1 is a configuration diagram of an air conditioner according to a first embodiment of the present invention.

A second aspect provides the refrigeration apparatus as set forth in the first aspect, wherein the heat medium circulating in the heat release circuit may be the refrigerant liquid retained in the condenser. The heat release circuit may include a heat release side feed path that feeds the refrigerant liquid from the condenser to the first heat exchanger and that is provided with a pump, and a heat release side return path that returns the refrigerant liquid from the first heat exchanger to the condenser. The vapor cooler may be disposed on the heat release side feed path. Since the vapor cooler is disposed on the heat release side feed path, it is possible to raise the temperature of the refrigerant liquid flowing into the first heat exchanger so as to increase the temperature difference between a medium to be heated (for example, indoor air) and the refrigerant liquid flowing into the first heat exchanger. Thus, the heating capacity of the refrigeration apparatus can be enhanced.

A third aspect provides the refrigeration apparatus as set forth in the second aspect, wherein the heat medium circulating in the heat absorption circuit may be the refrigerant liquid retained in the evaporator. The heat absorption circuit may include a heat absorption side feed path that feeds the refrigerant liquid from the evaporator to the second heat exchanger and that is provided with a pump, and a heat absorption side return path that returns the refrigerant liquid from the second heat exchanger to the evaporator. The refrigeration apparatus may further include an injection passage that injects the refrigerant liquid pumped from the pump in the heat absorption side feed path into a section of the refrigerant circuit between the vapor cooler and the second compressor. In the case where the injection passage is thus provided, the temperature of the refrigerant to be drawn into the second compressor can significantly lowered. Therefore, the reliability of the refrigeration apparatus, in particular, the reliability of the second compressor can be further improved.

A fourth aspect provides the refrigeration apparatus as set forth in the second or the third aspect, wherein the heat release side feed path may be provided with a bypass passage that bypasses the vapor cooler. The bypass passage may be provided with a flow rate regulating mechanism. In the case where the bypass passage having the flow rate regulating mechanism is provided, the amount of heat released from the refrigerant vapor between the first compressor and the second compressor can be optimally controlled.

A fifth aspect provides the refrigeration apparatus as set forth in the first aspect, wherein the heat medium circulating in the heat absorption circuit may be the refrigerant liquid retained in the evaporator. The heat absorption circuit may include a heat absorption side feed path that feeds the refrigerant liquid from the evaporator to the second heat exchanger and that is provided with a pump, and a heat absorption side return path that returns the refrigerant liquid from the second heat exchanger to the evaporator. The vapor cooler may be disposed on the heat absorption side feed path. According to the fifth aspect, in the vapor cooler, the refrigerant vapor can be cooled using the lower temperature refrigerant liquid. Therefore, the temperature of the refrigerant to be drawn into the second compressor can be further lowered.

A sixth aspect provides the refrigeration apparatus as set forth in the fifth aspect, which may further include an injection passage that injects the refrigerant liquid pumped from the pump in the heat absorption side feed path into a section of the refrigerant circuit between the vapor cooler and the second compressor. In the case where the injection passage is thus provided, the temperature of the refrigerant to be drawn into the second compressor can be lowered. Therefore, the reliability of the refrigeration apparatus, in particular, the reliability of the second compressor can be further improved.

A seventh aspect provides the refrigeration apparatus as set forth in the fifth or the sixth aspect, wherein the heat absorption side feed path may be provided with a bypass passage that bypasses the vapor cooler. The bypass passage may be provided with a flow rate regulating mechanism. In the case where the bypass passage having the flow rate regulating mechanism is provided, the amount of heat released from the refrigerant vapor between the first compressor and the second compressor can be optimally controlled.

A eighth aspect provides the refrigeration apparatus as set forth in any one of the fifth to seventh aspects, wherein the heat medium circulating in the heat release circuit may be the refrigerant liquid retained in the condenser. The heat release circuit may include a heat release side feed path that feeds the refrigerant liquid from the condenser to the first heat exchanger and that is provided with a pump, and a heat release side return path that returns the refrigerant liquid from the first heat exchanger to the condenser. This configuration eliminates the need for a heat medium other than the refrigerant liquid. Therefore, the refrigeration apparatus can be simplified.

A ninth aspect provides the refrigeration apparatus as set forth in any one of the first to eighth aspects, wherein the second heat exchanger may be a heat exchanger that absorbs heat from the atmosphere. In this case, the second heat exchanger can be disposed outdoors.

A tenth aspect of the present disclosure provides a refrigeration apparatus including: a refrigerant circuit that allows a refrigerant to circulate, the refrigerant circuit including an evaporator that retains a refrigerant liquid and that evaporates the refrigerant liquid therein, a first compressor that compresses a refrigerant vapor, a vapor cooler that cools the refrigerant vapor, a second compressor that compresses the refrigerant vapor, and a condenser that condenses the refrigerant vapor therein and that retains the refrigerant liquid, wherein the evaporator, the first compressor, the vapor cooler, the second compressor, and the condenser are connected in this order; a heat release circuit that allows a heat medium to circulate between the condenser and a first heat exchanger that releases heat to indoor air; and a heat absorption circuit that allows a heat medium to circulate between the evaporator and a second heat exchanger that absorbs heat from outdoor air, wherein the vapor cooler is a heat exchanger that exchanges heat between the refrigerant vapor compressed by the first compressor and air, and is disposed indoors or is disposed so as to heat the air to be supplied to the second heat exchanger.

According to the refrigeration apparatus described above, since heat is released from the first heat exchanger to the indoor air, heating can be performed. In addition, the heat released from the refrigerant vapor in the vapor cooler can be used for heating or recovered by the heat medium. Therefore, the heat loss in heating operation is significantly reduced. Thereby, the COP of the refrigeration apparatus can be improved.

An eleventh aspect provides the refrigeration apparatus as set forth in the tenth aspect, which may further include an indoor fan that supplies the indoor air to the first heat exchanger. The vapor cooler may be disposed in such a manner that a wind generated by the indoor fan passes through the first heat exchanger and then through the vapor cooler. In the tenth aspect, the vapor cooler is disposed on the leeward side of the first heat exchanger. Therefore, the size and layout of the vapor cooler can be arbitrarily determined.

A twelfth aspect provides the refrigeration apparatus as set forth in the tenth or the eleventh aspect, wherein the heat medium circulating in the heat absorption circuit may be the refrigerant liquid retained in the evaporator. The heat absorption circuit may include a heat absorption side feed path that feeds the refrigerant liquid from the evaporator to the second heat exchanger and that is provided with a pump, and a heat absorption side return path that returns the refrigerant liquid from the second heat exchanger to the evaporator. The refrigeration apparatus may further include an injection passage that injects the refrigerant liquid pumped from the pump in the heat absorption side feed path into a section of the refrigerant circuit between the vapor cooler and the second compressor. In the case where the injection passage is thus provided, the temperature of the refrigerant to be drawn into the second compressor can be significantly lowered. Therefore, the reliability of the refrigeration apparatus, in particular, the reliability of the second compressor can be further improved.

A thirteenth aspect provides the refrigeration apparatus as set forth in any one of the tenth to twelfth aspects, wherein the refrigerant circuit may be provided with a bypass passage that bypasses the vapor cooler. The bypass passage may be provided with a flow rate regulating mechanism. In the case where the bypass passage having the flow rate regulating mechanism is provided, the amount of heat released from the refrigerant vapor between the first compressor and the second compressor can be optimally controlled.

A fourteenth aspect provides the refrigeration apparatus as set forth in any one of the tenth to thirteenth aspects, wherein the heat medium circulating in the heat release circuit may be the refrigerant liquid retained in the condenser. The heat release circuit may include a heat release side feed path that feeds the refrigerant liquid from the condenser to the first heat exchanger and that is provided with a pump, and a heat release side return path that returns the refrigerant liquid from the first heat exchanger to the condenser. This configuration eliminates the need for a heat medium other than the refrigerant liquid. Therefore, the refrigeration apparatus can be simplified.

Hereinafter, embodiments of the present invention are described in detail based on the drawings.

First Embodiment

FIG. 1 shows an air conditioner 1A according to the first embodiment of the present invention. This air conditioner 1A includes: a refrigerant circuit 2 that allows a refrigerant to circulate; a heat release circuit 4 that allows a heat medium to circulate to cool the refrigerant; and a heat absorption circuit 6 that allows a heat medium to circulate to heat the refrigerant.

In the present embodiment, the heat release circuit 4 and the heat absorption circuit 6 are each a circuit that merges into the refrigerant circuit 2 to bring the heat medium into direct contact with the refrigerant, and the refrigerant circuit 2, the heat release circuit 4, and the heat absorption circuit 6 are filled with the same refrigerant. That is, a portion of the refrigerant is used as the heat medium. This refrigerant is a refrigerant whose saturated vapor pressure is a negative pressure at ordinary temperature, for example, a refrigerant whose main component is water, alcohol or ether, and the pressure in each of the refrigerant circuit 2, the heat release circuit 4, and the heat absorption circuit 6 is a negative pressure lower than the atmospheric pressure. A portion of a refrigerant liquid resulting from liquefaction of the refrigerant in the refrigerant circuit 2 circulates through the heat release circuit 4 and the heat absorption circuit 6. A refrigerant containing water as a main component and further containing ethylene glycol, Nybrine, an inorganic salt, or the like in an amount of 10 to 40% by mass can also be used as the refrigerant for the reasons such as prevention of freezing, etc. The term "main component" refers to a component whose content is the highest in mass.

The refrigerant circuit 2 includes an evaporator 25, a first compressor 21, a vapor cooler 3, a second compressor 22, a condenser 23, and an expansion valve 24, and these devices are connected in this order by flow paths. That is, the refrigerant circulating in the refrigerant circuit 2 passes through the evaporator 25, the first compressor 21, the vapor cooler 3, the second compressor 22, the condenser 23, and the expansion valve 24 in this order.

The evaporator 25 is a heat exchanger that retains the refrigerant liquid and allows this retained refrigerant liquid to be heated and evaporated therein by the refrigerant liquid circulating in the heat absorption circuit 6, or a heat exchanger that directly evaporates therein the refrigerant liquid that has been heated while circulating in the heat absorption circuit 6. In the present embodiment, the internal space of the evaporator 25 forms a flow path common to the refrigerant circuit 2 and the heat absorption circuit 6. Therefore, the refrigerant liquid in the evaporator 25 comes into direct contact with the refrigerant liquid circulating in the heat absorption circuit 6 as described above, and as a result, the heated refrigerant liquid and the refrigerant liquid serving as a heat medium for heating are mixed together to have almost the same temperature. In other words, a portion of the refrigerant liquid in the evaporator 25 is heated by a second heat exchanger 7 described later and used as a heat source for heating the saturated refrigerant liquid.

The refrigerant vapor is compressed in two stages by the first compressor 21 and the second compressor 22. The first compressor 21 and the second compressor 22 may each be a positive displacement compressor or a centrifugal compressor. The compression ratios of the first compressor and the second compressor can be determined as appropriate, and may have the same value. The temperature of the refrigerant vapor discharged from the first compressor 21 is, for example, 140° C., and the temperature of the refrigerant vapor discharged from the second compressor 22 is, for example, 170° C.

The vapor cooler 3 cools the refrigerant vapor discharged from the first compressor 21 before the refrigerant vapor is drawn into the second compressor 22. The vapor cooler 3 of the present embodiment is a heat exchanger that exchanges heat between the refrigerant vapor compressed by the first compressor 21 and the refrigerant liquid flowing in the heat release circuit 4. As the vapor cooler 3, for example, a shell-and-tube heat exchanger can be used. In this case, preferably, the refrigerant liquid flows in a tube and the refrigerant vapor flows in a shell surrounding the tube.

The condenser 23 is a heat exchanger that allows the refrigerant vapor discharged from the second compressor 22 to be cooled and condensed therein by the refrigerant liquid circulating in the heat release circuit 4 and that retains the refrigerant liquid resulting from the condensation. In the present embodiment, the internal space of the condenser 23 forms a flow path common to the refrigerant circuit 2 and the heat release circuit 4. Therefore, the refrigerant vapor discharged from the second compressor 22 comes into direct contact with the refrigerant liquid circulating in the heat release circuit 4 as described above, and as a result, the refrigerant liquid resulting from the condensation and the refrigerant liquid serving as a heat medium for cooling are mixed together to have almost the same temperature. In other words, a portion of the refrigerant liquid resulting from the condensation is supercooled in the first heat exchanger 5 described later and used as a heat source for cooling the superheated refrigerant vapor. The temperature of the refrigerant liquid resulting from the condensation is, for example 45° C.

The expansion valve 24 is one example of a pressure-reducing mechanism that reduces the pressure of the refrigerant liquid resulting from the condensation. The temperature of the pressure-reduced refrigerant liquid is, for example 5° C. The expansion valve 24 need not be provided in the refrigerant circuit 2, and, for example, a configuration in which the level of the refrigerant liquid in the evaporator 25 is higher than the level of the refrigerant liquid in the condenser 23 may be employed as a pressure-reducing mechanism.

The heat release circuit 4 allows the refrigerant liquid retained in the condenser 23 to circulate between the first heat exchanger 5 for releasing heat to the atmosphere and the condenser 23. The first heat exchanger 5 is disposed indoors and heats the indoor air supplied by an air blower 51. Thus, an indoor space is heated.

More specifically, the heat release circuit 4 includes a heat release side feed path 41 that feeds the refrigerant liquid from the condenser 23 to the first heat exchanger 5, and a heat release side return path 42 that returns the refrigerant liquid from the first heat exchanger 5 to the condenser 23. The heat release side feed path 41 is provided with a pump 43 that pumps the refrigerant liquid toward the first heat exchanger 5. In the heat release side feed path 41, the above-mentioned vapor cooler 3 is disposed downstream from the pump 43. The pump 43 is disposed at such a position that the height from the suction port of the pump to the level of the refrigerant liquid in the condenser 23 is larger than a required net positive suction head (required NPSH).

Preferably, the upstream end of the heat release side feed path 41 is connected to the lower part of the condenser 23. Preferably, a mechanism for dispersing the refrigerant liquid, such as a spray nozzle, is provided at the downstream end of the heat release side return path 42.

The heat absorption circuit 6 allows the refrigerant liquid retained in the evaporator 25 to circulate between the second heat exchanger 7 that absorbs heat from the atmosphere and the evaporator 25. The second heat exchanger 7 is disposed outdoors and cools the outdoor air supplied by an air blower 71.

More specifically, the heat absorption circuit 6 includes a heat absorption side feed path 61 that feeds the refrigerant liquid from the evaporator 25 to the second heat exchanger 7, and a heat absorption side return path 62 that returns the refrigerant liquid from the second heat exchanger 7 to the evaporator 25. The heat absorption side feed path 61 is provided with a pump 63 that pumps the refrigerant liquid toward the second heat exchanger 7. The pump 63 is disposed at such a position that the height from the suction port of the pump to the level of the refrigerant liquid in the evaporator 25 is larger than a required net positive suction head (required NPSH).

Preferably, the upstream end of the heat absorption side feed path 61 is connected to the lower portion of the evaporator 25. Preferably, the downstream end of the heat absorption side return path 62 is connected to the middle part of the evaporator 25.

Next, how the air conditioner 1A works is described.

The refrigerant vapor compressed by the first compressor 21 is cooled in the vapor cooler 3 by the refrigerant liquid resulting from the condensation, and then drawn into the second compressor 22. The refrigerant vapor further compressed by the second compressor 22 is condensed in the condenser 23 by heat exchange with the refrigerant liquid supercooled in the first heat exchanger 5. A portion of the refrigerant liquid resulting from the condensation in the condenser 23 is fed to the vapor cooler 3 by the pump 43, exchanges heat with the refrigerant vapor compressed by the first compressor, and then is pumped to the first heat exchanger 5. The refrigerant liquid pumped to the first heat exchanger 5 releases heat to the indoor air in the first heat exchanger 5 and then returns to the condenser 23.

The remaining portion of the refrigerant liquid resulting from the condensation in the condenser 23 is introduced into the evaporator 25 via the expansion valve 24. A portion of the refrigerant liquid in the evaporator 25 is pumped by the pump 63 to the second heat exchanger 7, absorbs heat from the outdoor air in the second heat exchanger 7, and then returns to the evaporator 25. The refrigerant liquid in the evaporator 25 is evaporated by being boiled under a reduced pressure, and the refrigerant vapor resulting from the evaporation is drawn into the first compressor 21.

In the air conditioner 1A of the present embodiment, the heat released from the refrigerant vapor in the vapor cooler 3 can be recovered by the refrigerant liquid serving as a heat medium for heating the indoor air. Therefore, the heat loss in the heating operation is significantly reduced. Thereby, the COP of the air conditioner 1A can be improved.

In addition, since the refrigerant vapor is cooled in the vapor cooler 3 before the refrigerant vapor is drawn into the second compressor 22, the amount of scale deposited on the second compressor 22 can be reduced even if the refrigerant contains impurities. Thereby, the reliability of the second compressor 22 can be improved.

Furthermore, in the present embodiment, since the vapor cooler 3 is disposed on the heat release side feed path 41, the temperature of the refrigerant liquid flowing into the first heat exchanger 5 can be raised to increase the temperature difference between the indoor air and the heat medium for heating the indoor air. Thus, the heating capacity of the air conditioner 1A can be enhanced.

<Modification>

Various modifications can be made to the air conditioner 1A of the previously-described embodiment.

Figure 2:
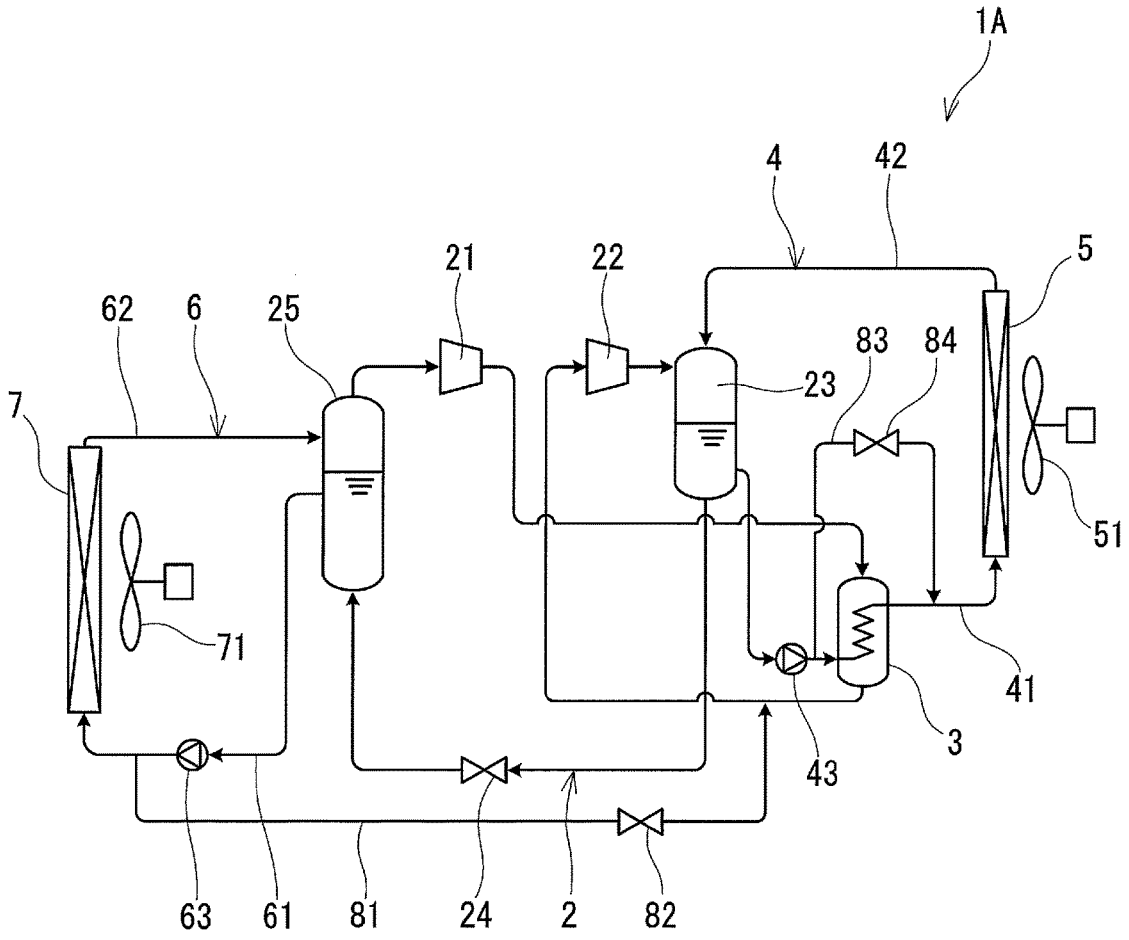
FIG. 2 is a configuration diagram of an air conditioner of a modification of the first embodiment.

For example, as shown in FIG. 2, the air conditioner 1A may include an injection passage 81 that injects the refrigerant liquid pumped from the pump 63 in the heat absorption side feed path 61 into a section of the refrigerant circuit 2 between the vapor cooler 3 and the second compressor 22. In this case, since the injection is performed by means of pumping of the pump 63, the upstream end of the injection passage 81 is connected to a position downstream from the pump 63 in the heat absorption side feed path 61. The injection passage 81 is provided with an injection valve 82 for regulating the injection flow rate.

A portion of the refrigerant liquid withdrawn from the evaporator 25 does not flow into the second heat exchanger 7 but is injected into the refrigerant circuit 2 between the vapor cooler 3 and the second compressor 22 through the injection passage 81. The opening degree of the injection valve 82 is controlled, for example, based on the temperature of the refrigerant discharged from the second compressor 22. That is, when the temperature of the refrigerant discharged from the second compressor 22 is higher than a predetermined value, control for increasing the opening degree of the injection valve 82 is performed.

In the case where the injection passage 81 is thus provided, the temperature of the refrigerant to be drawn into the second compressor 22 can be significantly lowered. Therefore, the reliability of the air conditioner 1A, in particular, the reliability of the second compressor 22 can be further improved.

As another modification, as shown in FIG. 2, the heat release side feed path 41 may be provided with a bypass passage 83 that bypasses the vapor cooler 3. The bypass passage 83 is branched from the heat release side feed path 41 at a position between the pump 43 and the vapor cooler 3 and is connected to the heat release side feed path 41 at a position downstream from the vapor cooler 3. The bypass passage 83 is provided with a flow rate regulating valve (a flow rate regulating mechanism) 84.

In the case where the bypass passage 83 having the flow rate regulating valve 84 is thus provided, the amount of heat released from the refrigerant vapor between the first compressor 21 and the second compressor 22 can be optimally controlled. In the case where a less amount of heat released from the refrigerant vapor is enough for the operation of the air conditioner 1A under certain conditions, the refrigerant liquid is allowed to flow preferentially in the bypass passage 83 so as to perform control of reducing the amount of released heat. Thus, the COP and comfort level of the air conditioner 1A are improved.

For example, the flow rate regulating valve 84 is controlled to move to a full open position for a predetermined period of time (for example, 3 minutes) from the startup of the air conditioner 1A. Thereby, the amount of heat released from the refrigerant vapor discharged from the first compressor 21 is reduced, which makes it possible to accelerate the rate of increase in the temperature of the refrigerant vapor discharged from the second compressor 22. As a result, the startup time of the air conditioner 1A can be reduced, and thus the comfort level in the heating operation can be improved. After the elapse of the predetermined period of time, the flow rate regulating valve 84 is controlled to move to a close position to reduce the bypass flow rate gradually. Thus, the reliability of the second compressor 22 is ensured.

Figure 3:
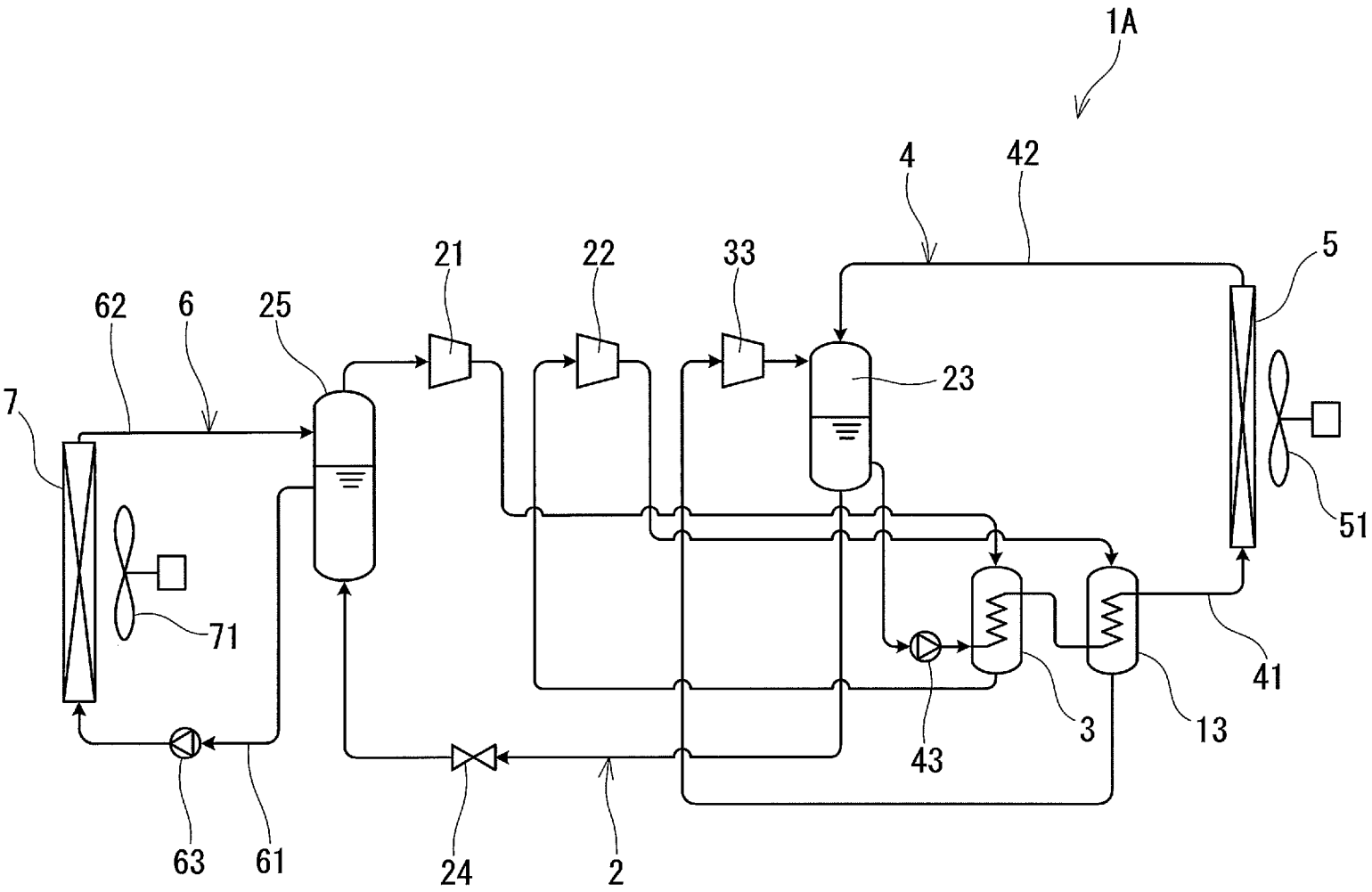
FIG. 3 is a configuration diagram of an air conditioner of another modification of the first embodiment.

As shown in FIG. 3, the air conditioner 1A according to still another modification may include a third compressor 33 and a second vapor cooler 13. In the refrigerant circuit 2, the evaporator 25, the first compressor 21, the vapor cooler 3 (a first vapor cooler), the second compressor 22, the second vapor cooler 13, the third compressor 33, the condenser 23, and the expansion valve 24 are connected in this order. According to the third compressor 33, efficient heating operation can be performed when the outdoor air temperature is low and efficient cooling operation can be performed when the outdoor air temperature is high.

The third compressor 33 compresses the refrigerant compressed by the second compressor 22. The third compressor 33 may be a positive displacement compressor or a centrifugal compressor. The second vapor cooler 13 cools the refrigerant vapor discharged from the second compressor 22 before the refrigerant vapor is drawn into the third compressor 33. The second vapor cooler 13 is a heat exchanger that exchanges heat between the refrigerant vapor compressed by the second compressor 22 and the refrigerant liquid flowing in the heat release circuit 4. As the second vapor cooler 13, for example, a shell-and-tube heat exchanger can be used, like the vapor cooler 3. In this case, preferably, the refrigerant liquid flows in a tube and the refrigerant vapor flows in a shell surrounding the tube.

The second vapor cooler 13 is disposed between the first vapor cooler 3 and the first heat exchanger 5 in the heat release side feed path 41. That is, the refrigerant liquid can be heated in two stages by the first vapor cooler 3 and the second vapor cooler 13. Therefore, the heating capacity of the air conditioner 1A can be further enhanced.

Figure 4:
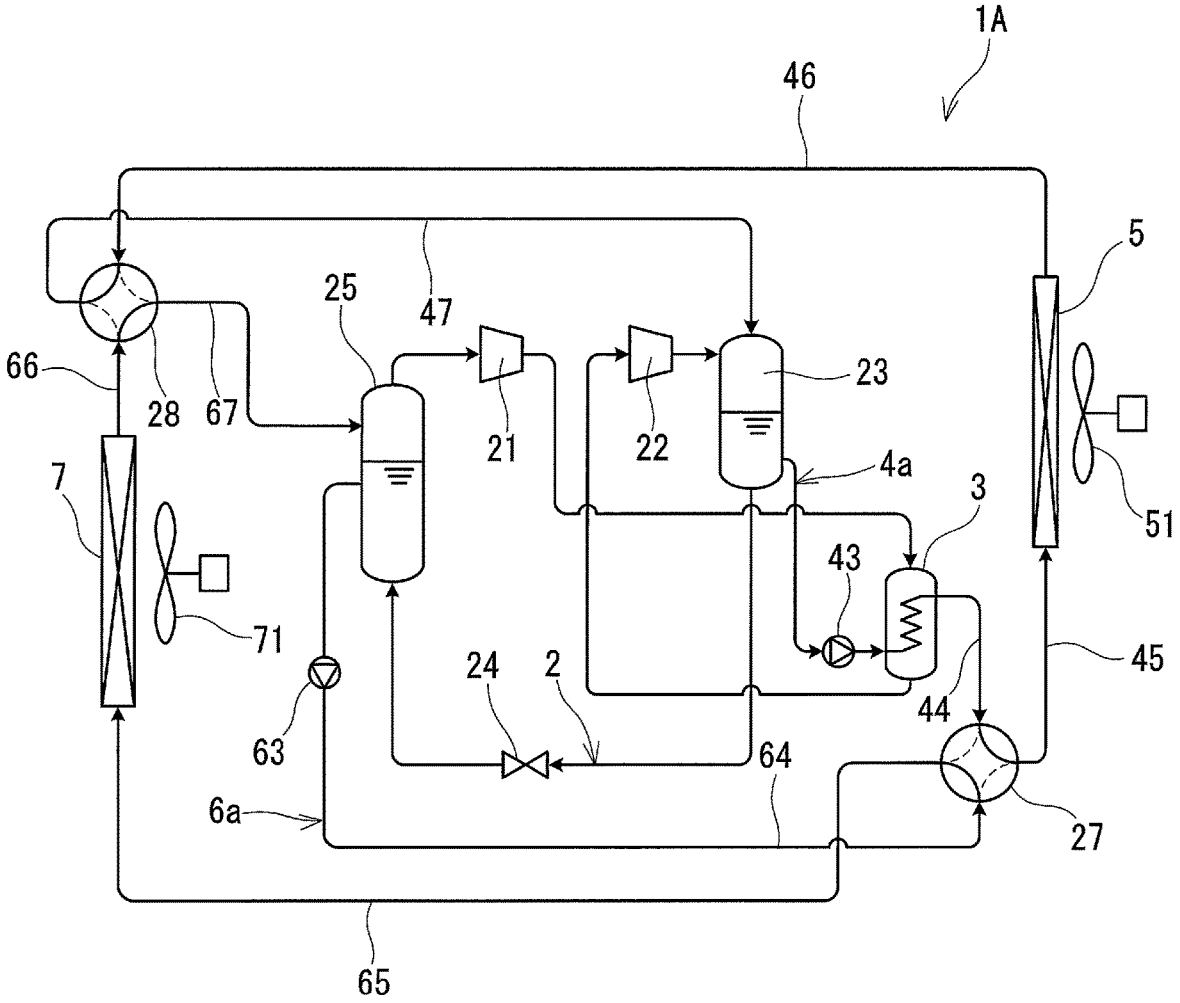
FIG. 4 is a configuration diagram of an air conditioner of still another modification of the first embodiment.

As shown in FIG. 4, in still another modification, the air conditioner 1A includes a first circulation path 4*a*, a second circulation path 6*a*, a first switching valve 27, and a second switching valve 28. The first circulation path 4*a* is a path that allows the refrigerant liquid retained in the condenser 23 to circulate via the first heat exchanger 5. The first circulation path 4*a* corresponds to the heat release circuit 4. In the first circulation path 4*a*, the pump 43 (a first pump) is provided at a position upstream from the first heat exchanger 5. The second circulation path 6*a* is a path that allows the refrigerant liquid retained in the evaporator 25 to circulate via the second heat exchanger 7. The second circulation path 6*a* corresponds to the heat absorption circuit 6. In the second circulation path 6*a*, the pump 63 (a second pump) is provided at a position upstream from the second heat exchanger 7. The first switching valve 27 is provided in the first circulation path 4*a* and the second circulation path 6*a*. The first switching valve 27 is switched between a first state and a second state. In the first state, the refrigerant liquid pumped from the first pump 43 is directed to the first heat exchanger 5 and the refrigerant liquid pumped from the second pump 63 is directed to the second heat exchanger 7. In the second state, the refrigerant liquid pumped from the first pump 43 is directed to the second heat exchanger 7 and the refrigerant liquid pumped from the second pump 63 is directed to the first heat exchanger 5. The second switching valve 28 also is provided in the first circulation path 4*a* and the second circulation path 6*a*. The second switching valve 28 is switched between a first state and a second state. In the first state, the refrigerant liquid flowing from the first heat exchanger 5 is directed to the condenser 23 and the refrigerant liquid flowing from the second heat exchanger 7 is directed to the evaporator 25. In the second state, the refrigerant liquid flowing from the first heat exchanger 5 is directed to the evaporator 25 and the refrigerant liquid flowing from the second heat exchanger 7 is directed to the condenser 23. The use of the first switching valve 27 and the second switching valve 28 makes it possible to switch between cooling operation and heating operation.

A section of the first circulation path 4*a* between the first pump 43 and the first heat exchanger 5 intersects with a section of the second circulation path 6*a* between the second pump 63 and the second heat exchanger 7, and the first switching valve 27 is provided at the intersection. Furthermore, a section of the first circulation path 4*a* between the first heat exchanger 5 and the condenser 23 intersects with a section of the second circulation path 6*a* between the second heat exchanger 7 and the evaporator 25, and the second switching valve 28 is provided at the intersection.

More specifically, the first circulation path 4*a* includes: a first flow path 41 connecting the condenser 23 and the first switching valve 27 and provided with the first pump 43 and the vapor cooler 3; a second flow path 45 connecting the first switching valve 27 and the first heat exchanger 5; a third flow path 46 connecting the first heat exchanger 5 and the second switching valve 28; and a fourth flow path 47 connecting the second switching valve 28 and the condenser 23. The first flow path 44 and the second flow path 45 correspond to the heat release side feed path 41. The third flow path 46 and the fourth flow path 47 correspond to the heat release side return path 42.

Likewise, the second circulation path 6*a* includes: a first flow path 64 connecting the evaporator 25 and the first switching valve 27 and provided with the second pump 63; a second flow path 65 connecting the first switching valve 27 and the second heat exchanger 7; a third flow path 66 connecting the second heat exchanger 7 and the second switching valve 28; and a fourth flow path 67 connecting the second switching valve 28 and the evaporator 25. The first flow path 64 and the second flow path 65 correspond to the heat absorption side feed path 61. The third flow path 66 and the fourth flow path 67 correspond to the heat absorption side return path 62. The vapor cooler 3 may be disposed on the second circulation path 6*a*, as described later.

As the first switching valve 27, a four-way valve may be used, or a plurality of three-way valves may be used. The same applies to the second switching valve 28.

Second Embodiment

Figure 5:
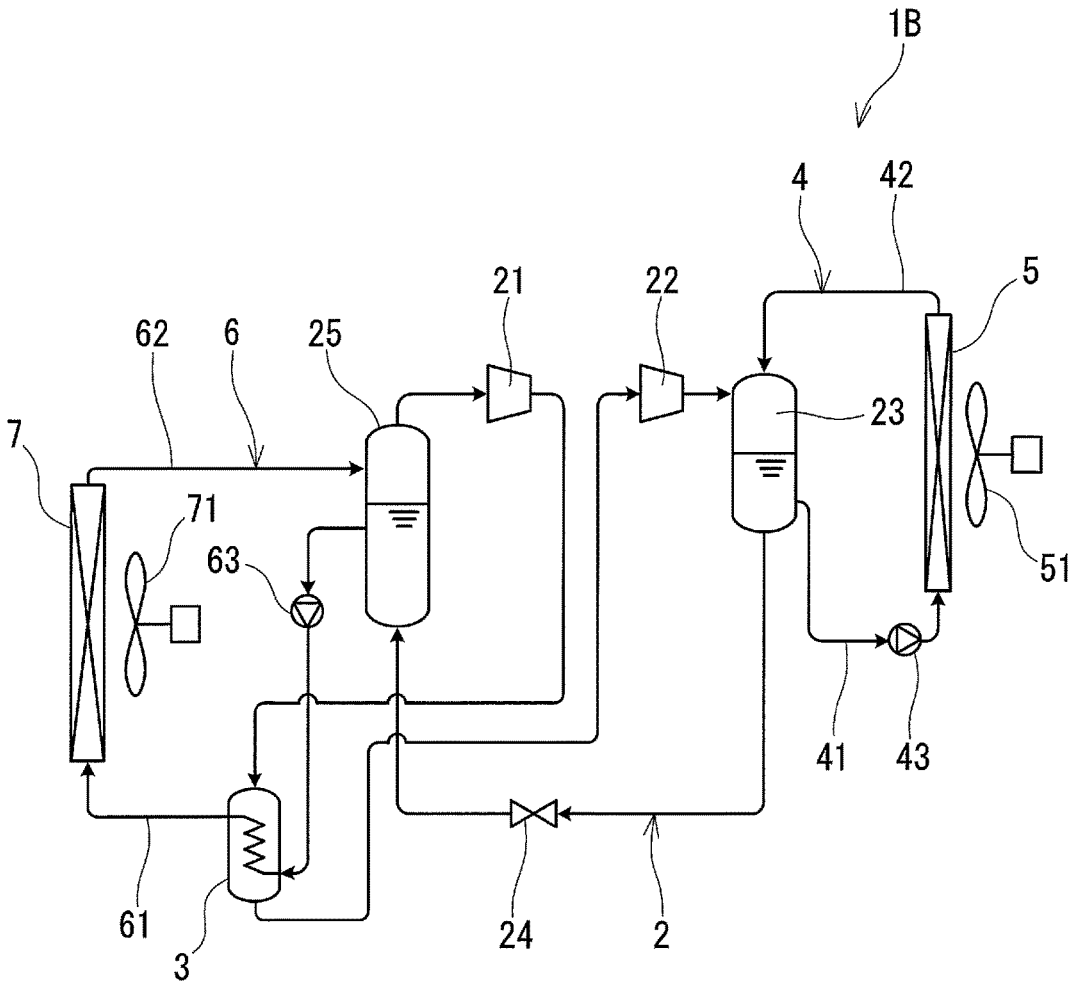
FIG. 5 is a configuration diagram of an air conditioner according to a second embodiment of the present invention.

FIG. 5 shows an air conditioner 1B according to the second embodiment of the present invention. In the second to fourth embodiments, the same components as those in the first embodiment are denoted by the same reference numerals, and the description thereof is partially omitted.

In the present embodiment, the vapor cooler 3 is not disposed on the heat release circuit 4 but on the heat absorption circuit 6. That is, the vapor cooler 3 of the present embodiment is a heat exchanger that exchanges heat between the refrigerant vapor compressed by the first compressor 21 and the refrigerant liquid flowing in the heat absorption circuit 6. More specifically, the vapor cooler 3 is disposed downstream from the pump 63 in the heat absorption side feed path 61.

In the present embodiment, since the refrigerant vapor can be cooled using the refrigerant liquid having a lower temperature than that in the first embodiment, the temperature of the refrigerant to be drawn into the second compressor 22 can be further lowered. Therefore, the air conditioner 1B of the present embodiment is particularly useful when the temperature of the refrigerant discharged from the second compressor 22 becomes higher, for example, when the air conditioner 1B is used in a cold climate area. In addition to this effect, the same effects as those of the first embodiment can be obtained.

<Modification>

Various modifications can be made to the air conditioner 1B of the previously-described embodiment.

Figure 6:
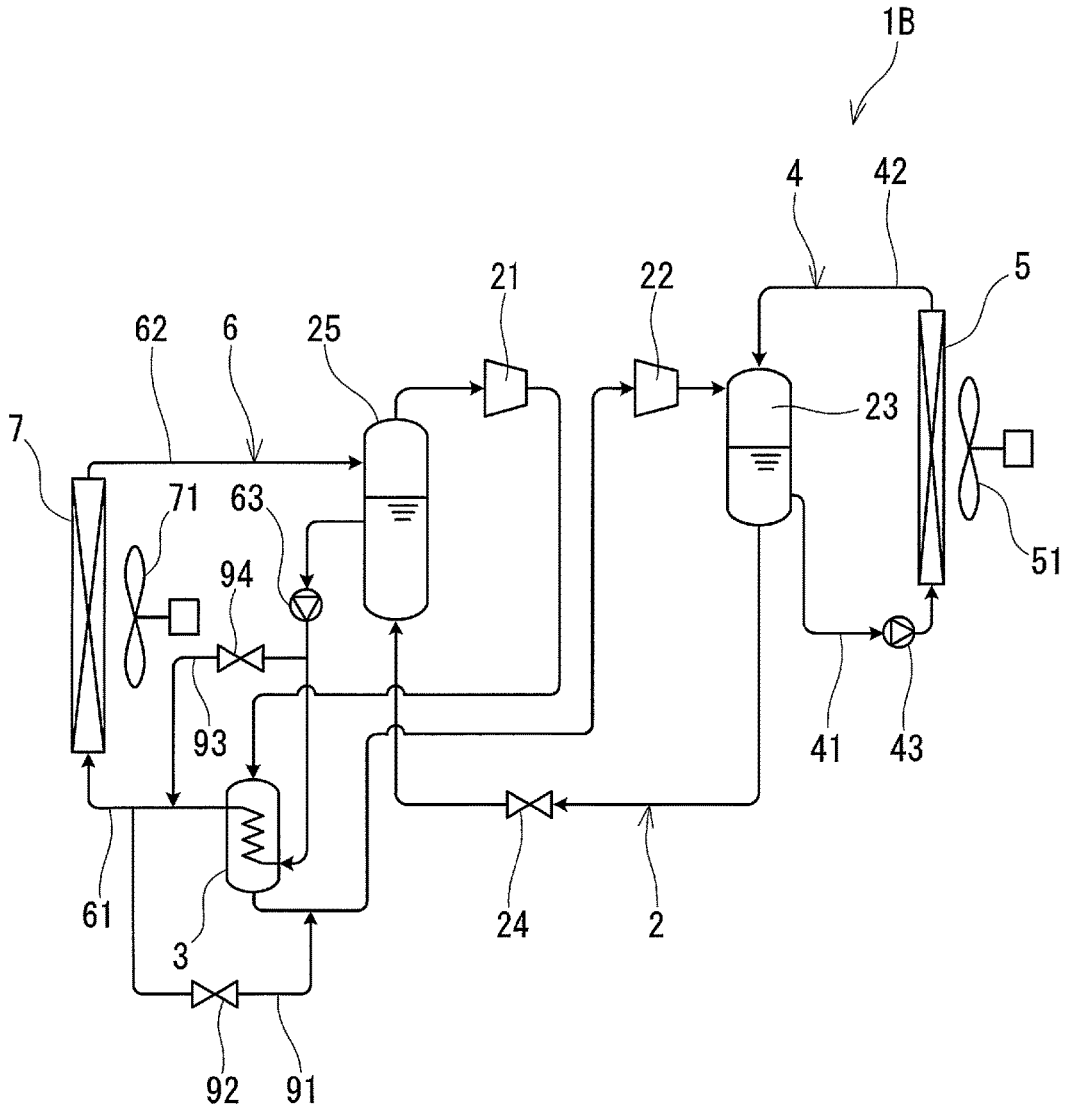
FIG. 6 is a configuration diagram of an air conditioner of a modification of the second embodiment.

For example, as shown in FIG. 6, the air conditioner 1B may include an injection passage 91 that injects the refrigerant liquid pumped from the pump 63 in the heat absorption side feed path 61 into a section of the refrigerant circuit 2 between the vapor cooler 3 and the second compressor 22. In this case, the injection is performed by means of pumping of the pump 63, as in the modification of the first embodiment. In the example shown in FIG. 6, the upstream end of the injection passage 91 is connected to a position downstream from the vapor cooler 3 in the heat absorption side feed path 61. The injection passage 91 is provided with an injection valve 92 for regulating the injection flow rate.

In the case where the injection passage 91 is thus provided, the temperature of the refrigerant to be drawn into the second compressor 22 can be lowered, as in the modification of the first embodiment. Therefore, the reliability of the air conditioner 1B, in particular, the reliability of the second compressor 22 can be further improved. Needless to say, the same effects can be obtained even if the upstream end of the injection passage 91 is connected to a position upstream from the vapor cooler 3, not to a position downstream from the vapor cooler 3, in the heat absorption side feed path 61.

As another modification, as shown in FIG. 6, the heat absorption side feed path 61 may be provided with a bypass passage 93 that bypasses the vapor cooler 3. The bypass passage 93 is branched from the heat absorption side feed path 61 at a position between the pump 63 and the vapor cooler 3 and is connected to the heat absorption side feed path 61 at a position downstream from the vapor cooler 3. The bypass passage 93 is provided with a flow rate regulating valve (a flow rate regulating mechanism) 94.

In the case where the bypass passage 93 having the flow rate regulating valve 94 is thus provided, the amount of heat released from the refrigerant vapor between the first compressor 21 and the second compressor 22 can be optimally controlled, as in the modification of the first embodiment. In the case where a less amount of heat released from the refrigerant vapor is enough for the operation of the air conditioner 1B under certain conditions, the refrigerant liquid is allowed to flow preferentially in the bypass passage 93 so as to perform control of reducing the amount of released heat. Thus, the COP and comfort level of the air conditioner 1B are improved.

For example, the flow rate regulating valve 94 is controlled to move to a full open position for a predetermined period of time (for example, 3 minutes) from the startup of the air conditioner 1B. Thereby, the amount of heat released from the refrigerant vapor discharged from the first compressor 21 is reduced, which makes it possible to accelerate the rate of increase in the temperature of the refrigerant vapor discharged from the second compressor 22. As a result, the startup time of the air conditioner 1B can be reduced, and thus the comfort level in the heating operation can be improved. After the elapse of the predetermined period of time, the flow rate regulating valve 94 is controlled to move to a close position to reduce the bypass flow rate gradually. Thus, the reliability of the second compressor 22 is ensured.

Figure 7:
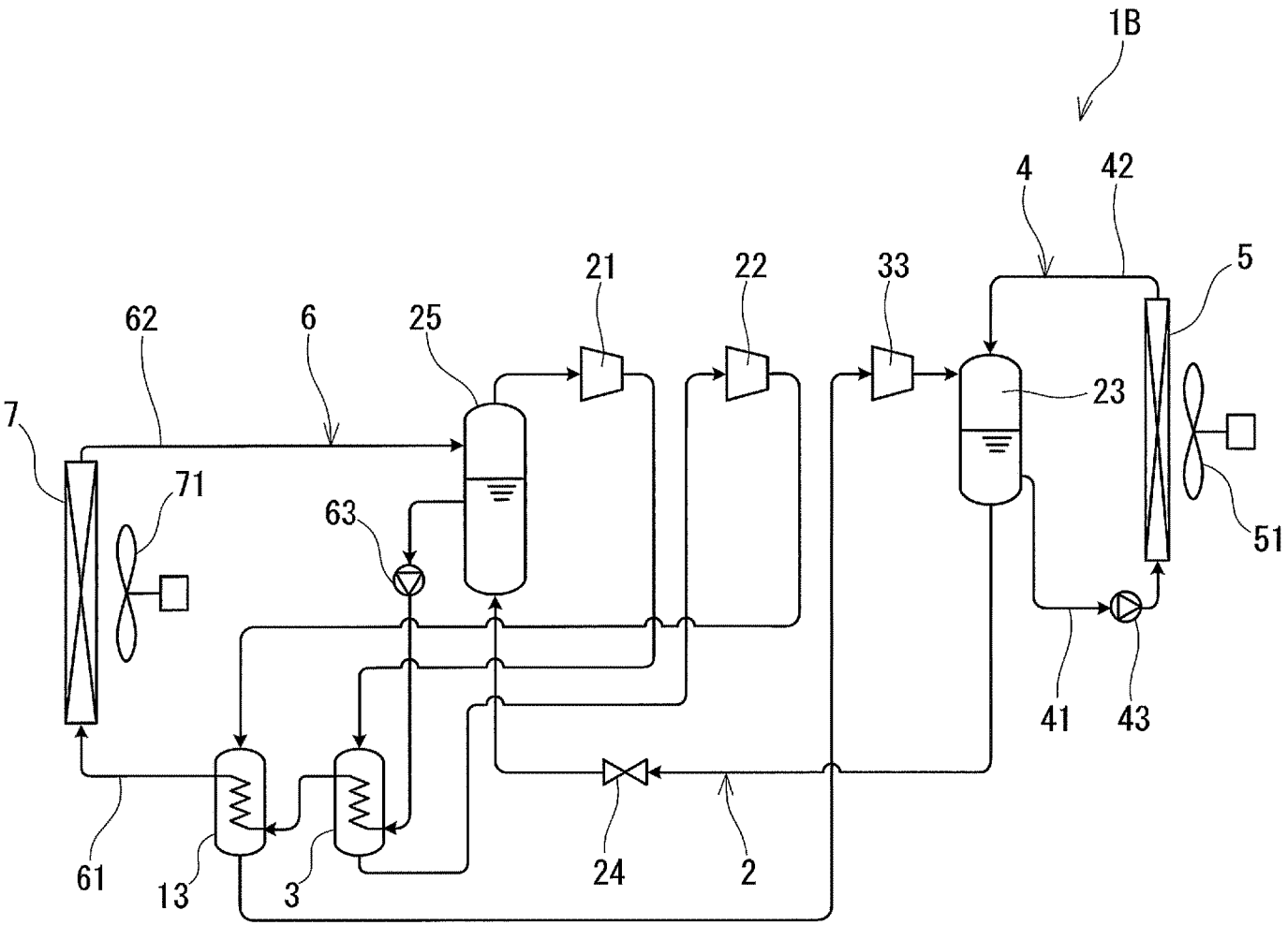
FIG. 7 is a configuration diagram of an air conditioner of another modification of the second embodiment.

In still another modification, as shown in FIG. 7, the air conditioner 1B may include a third compressor 33 and a second vapor cooler 13. The second vapor cooler 13 cools the refrigerant vapor discharged from the second compressor 22 before the refrigerant vapor is drawn into the third compressor 33. The second vapor cooler 13 is a heat exchanger that exchanges heat between the refrigerant vapor compressed by the second compressor 22 and the refrigerant liquid flowing in the heat absorption circuit 6. More specifically, the second vapor cooler 13 is disposed between the first vapor cooler 3 and the second heat exchanger 7 in the heat absorption feed path 61. This configuration makes it possible to efficiently apply heat to the refrigerant liquid flowing in the heat absorption circuit 6.

Third Embodiment

Figure 8:
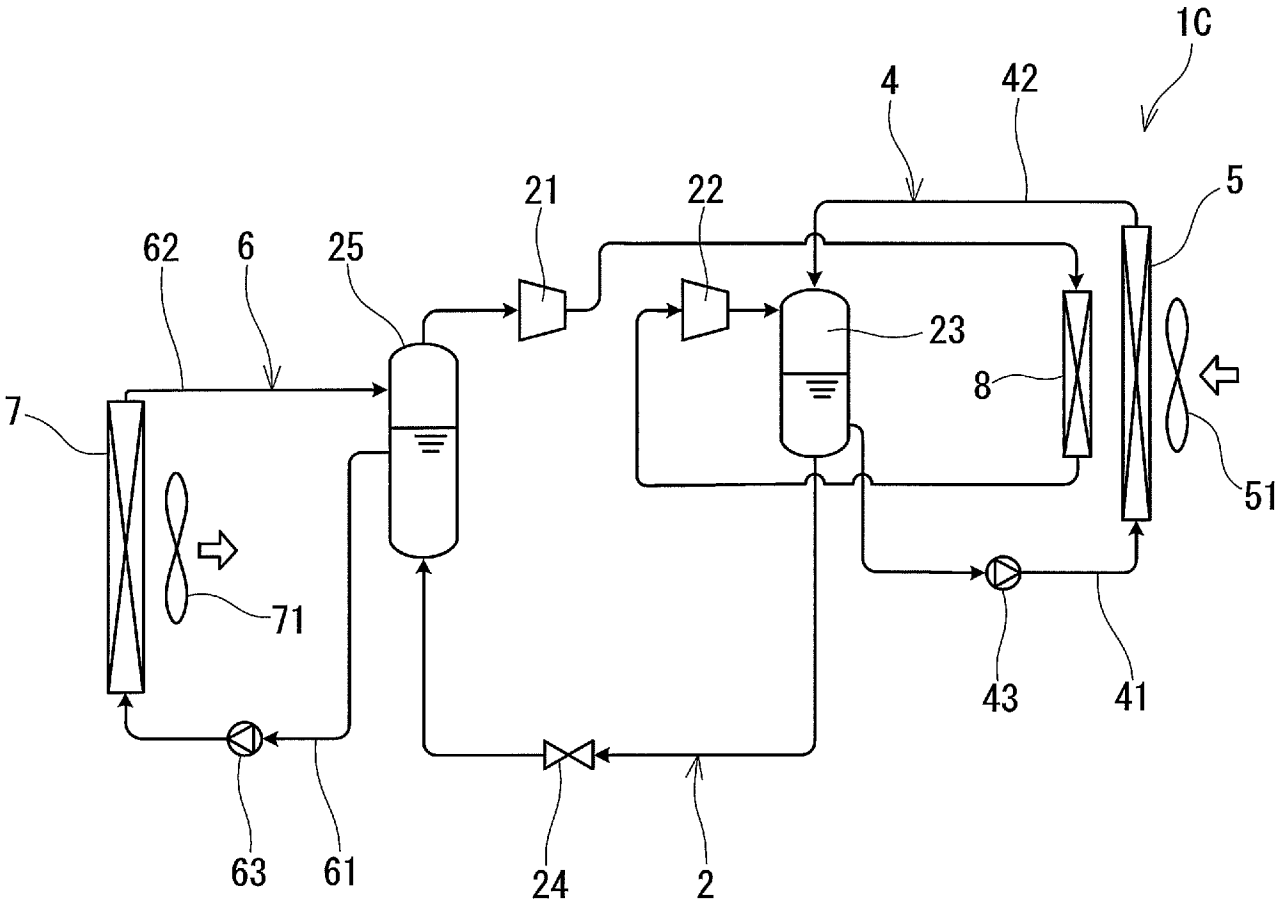
FIG. 8 is a configuration diagram of an air conditioner according to a third embodiment of the present invention.

FIG. 8 shows an air conditioner 1C according to the third embodiment of the present invention. This air conditioner 1C includes the refrigerant circuit 2, the heat release circuit 4, and the heat absorption circuit 6. The structures and functions of these circuits are as described in the first embodiment. A vapor cooler 8 is disposed on the refrigerant circuit 4.

The vapor cooler 8 is a heat exchanger that exchanges heat between the refrigerant vapor compressed by the first compressor 21 and air, and cools the refrigerant vapor discharged from the first compressor 21 before the refrigerant vapor is drawn into the second compressor 22. In the present embodiment, the vapor cooler 8 is disposed indoors. As the vapor cooler 8, for example, a fin-and-tube heat exchanger can be used.

In the present embodiment, the above-mentioned vapor cooler 8 is disposed in such a manner that a wind generated by an air blower 51 (an indoor fan 51) passes through the first heat exchanger 5 and then through this vapor cooler 8. In other words, the first heat exchanger 5 and the vapor cooler 8 are arranged side by side in the direction of the air flow by the indoor fan 51, and the vapor cooler 8 is located on the leeward side of the first heat exchanger 5.

Next, how the air conditioner 1C works is described.

The refrigerant vapor compressed by the first compressor 21 releases heat to the indoor air in the vapor cooler 8, and then is drawn into the second compressor 22. The refrigerant vapor further compressed by the second compressor 22 is condensed in the condenser 23 by heat exchange with the refrigerant liquid supercooled in the first heat exchanger 5. A portion of the refrigerant liquid resulting from the condensation in the condenser 23 is pumped to the first heat exchanger 5 by the pump 43. The refrigerant liquid pumped to the first heat exchanger 5 releases heat to the indoor air in the first heat exchanger 5 and then returns to the condenser 23.

The remaining portion of the refrigerant liquid resulting from the condensation in the condenser 23 is introduced into the evaporator 25 via the expansion valve 24. A portion of the refrigerant liquid in the evaporator 25 is pumped by the pump 63 to the second heat exchanger 7, absorbs heat from the outdoor air in the second heat exchanger 7, and then returns to the evaporator 25. The refrigerant liquid in the evaporator 25 is evaporated by being boiled under a reduced pressure, and the refrigerant vapor resulting from the evaporation is drawn into the first compressor 21.

In the air conditioner 1C of the present embodiment, the heat released from the refrigerant vapor in the vapor cooler 8 can be used for heating operation. Therefore, the heat loss in the heating operation is significantly reduced. Thereby, the COP of the air conditioner 1C can be improved.

The vapor cooler 8 need not necessarily be disposed on the leeward side of the first heat exchanger 5, and for example, it may be disposed on the windward side of the first heat exchanger 5. However, in this case, the temperature of the air supplied to the first heat exchanger 5 rises. Therefore, some measures need to be taken. For example, the vapor cooler 8 needs to be disposed in an area near the refrigerant liquid outlet of the first heat exchanger 5. In contrast, in the present embodiment, the vapor cooler 8 is disposed on the leeward side of the first heat exchanger 5. Therefore, the size and layout of the vapor cooler 8 can be arbitrarily determined.

Even if the vapor cooler 8 is not disposed near the first heat exchanger 5, the heat released from the refrigerant vapor in the vapor cooler 8 can be used for heating operation as long as the vapor cooler 8 is disposed indoors.

<Modification>

Various modifications can be made to the air conditioner 1C of the previously-described embodiment.

Figure 9:
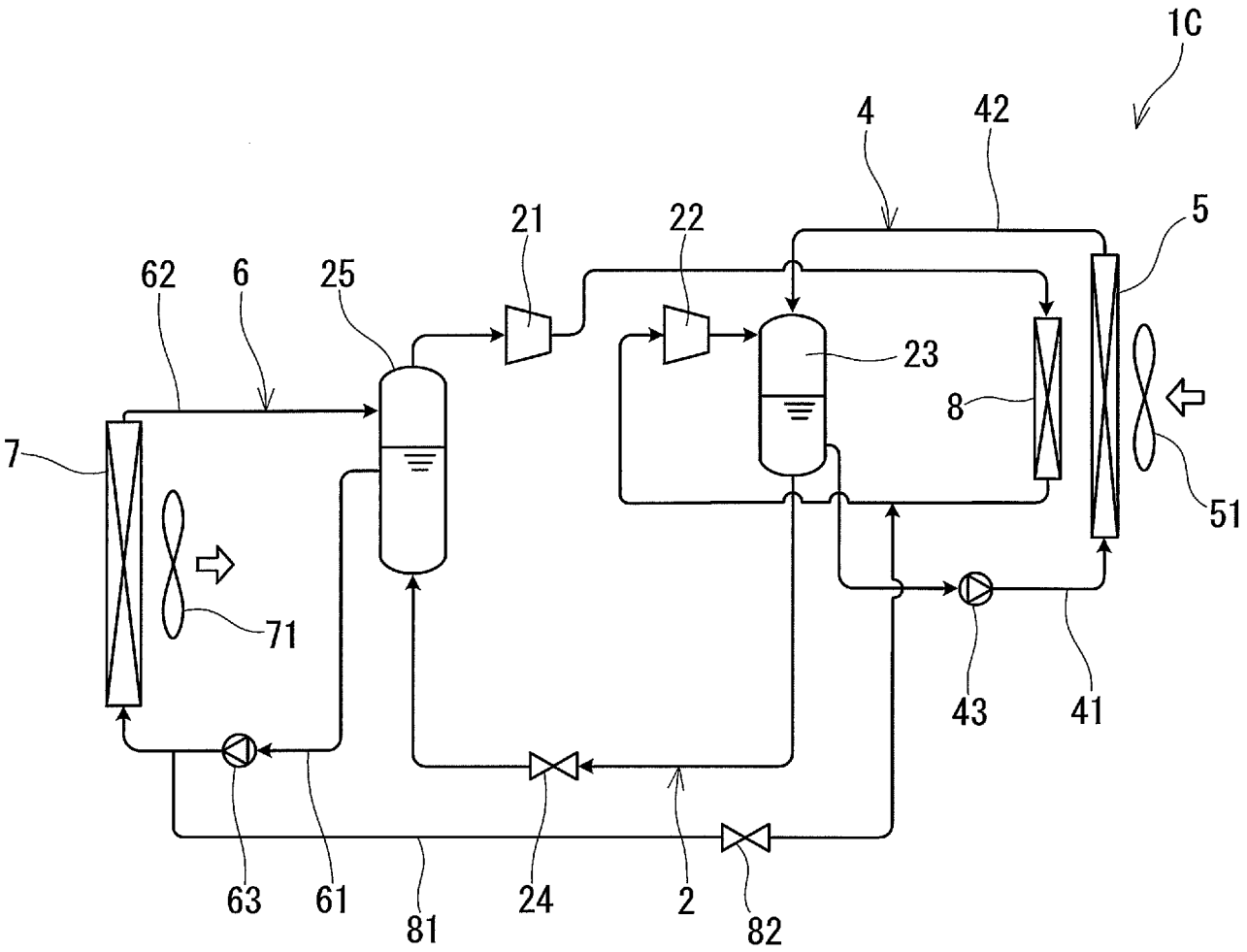
FIG. 9 is a configuration diagram of an air conditioner of a modification of the third embodiment.

For example, as shown in FIG. 9, the air conditioner 1C may include an injection passage 81 that injects the refrigerant liquid pumped from the pump 63 in the heat absorption side feed path 61 into a section of the refrigerant circuit 2 between the vapor cooler 8 and the second compressor 22. In this case, since the injection is performed by means of pumping of the pump 63, the upstream end of the injection passage 81 is connected to a position downstream from the pump 63 in the heat absorption feed path 61. The injection passage 81 is provided with an injection valve 82 for regulating the injection flow rate.

A portion of the refrigerant liquid withdrawn from the evaporator 25 does not flow into the second heat exchanger 7 but is injected into the refrigerant circuit 2 between the vapor cooler 8 and the second compressor 22 through the injection valve passage 81. The opening degree of the injection valve 82 is controlled, for example, based on the temperature of the refrigerant discharged from the second compressor 22. That is, when the temperature of the refrigerant discharged from the second compressor 22 is higher than a predetermined value, control for increasing the opening degree of the injection valve 82 is performed.

In the case where the injection passage 81 is thus provided, the temperature of the refrigerant to be drawn into the second compressor 22 can be significantly lowered. Therefore, the reliability of the air conditioner 1C, in particular, the reliability of the second compressor 22 can be further improved.

Figure 10:
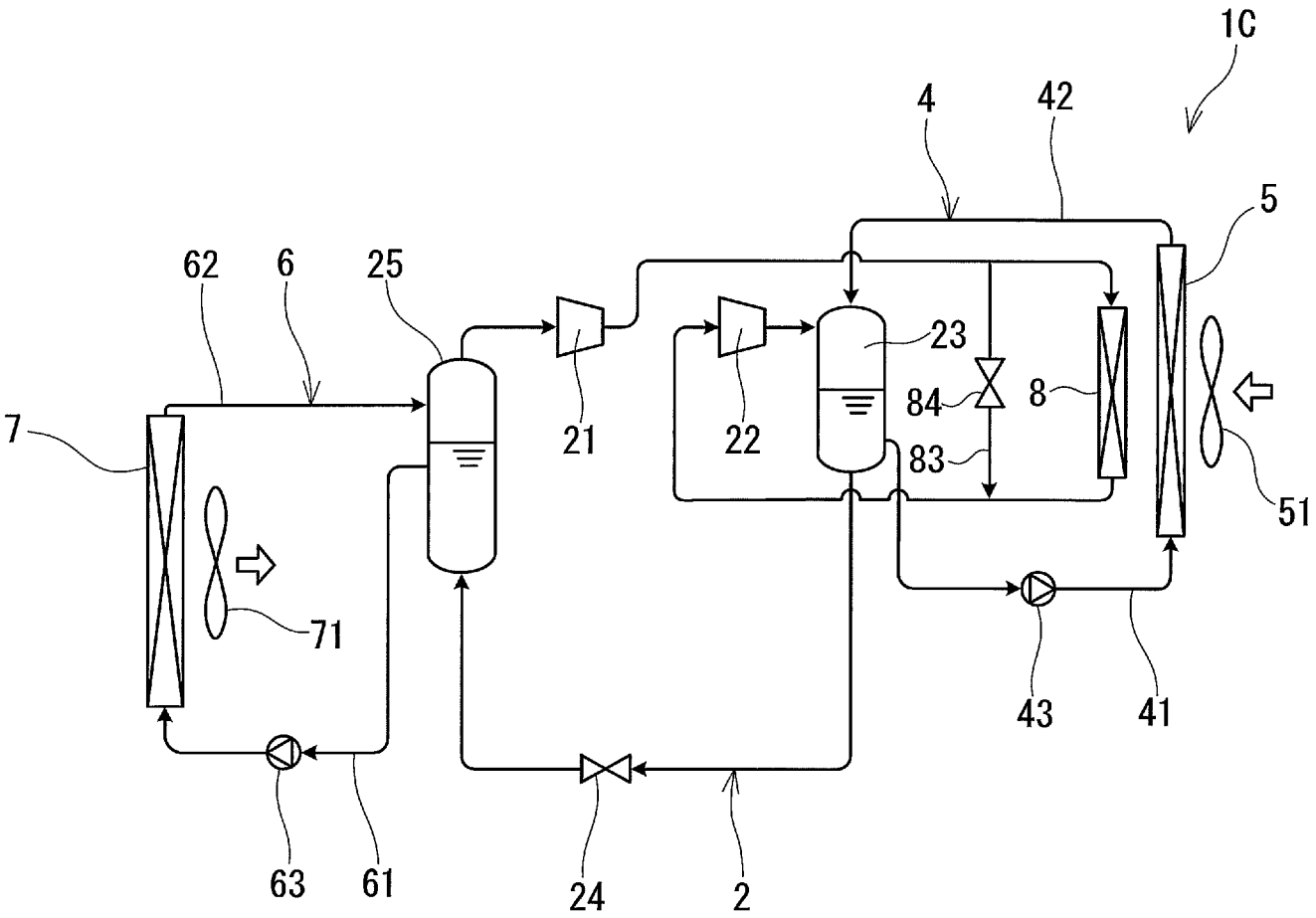
FIG. 10 is a configuration diagram of an air conditioner of another modification of the third embodiment.

As another modification, as shown in FIG. 10, the refrigerant circuit 2 may be provided with a bypass passage 83 that bypasses the vapor cooler 8. The bypass passage 83 is branched from the refrigerant circuit 2 at a position between the first compressor 21 and the vapor cooler 8 and is connected to the refrigerant circuit 2 at a position between the vapor cooler 8 and the second compressor 22. The bypass passage 83 is provided with a flow rate regulating valve (a flow rate regulating mechanism) 84.

In the case where the bypass passage 83 having the flow rate regulating valve 84 is thus provided, the amount of heat released from the refrigerant vapor between the first compressor 21 and the second compressor 22 can be optimally controlled. In the case where a less amount of heat released from the refrigerant vapor is enough for the operation of the air conditioner 1C under certain conditions, the refrigerant liquid is allowed to flow preferentially in the bypass passage 83 so as to perform control of reducing the amount of released heat. Thus, the COP and comfort level of the air conditioner 1C are improved. The example of the method for controlling the flow rate regulating valve 84 is as described in the first embodiment.

Figure 11:
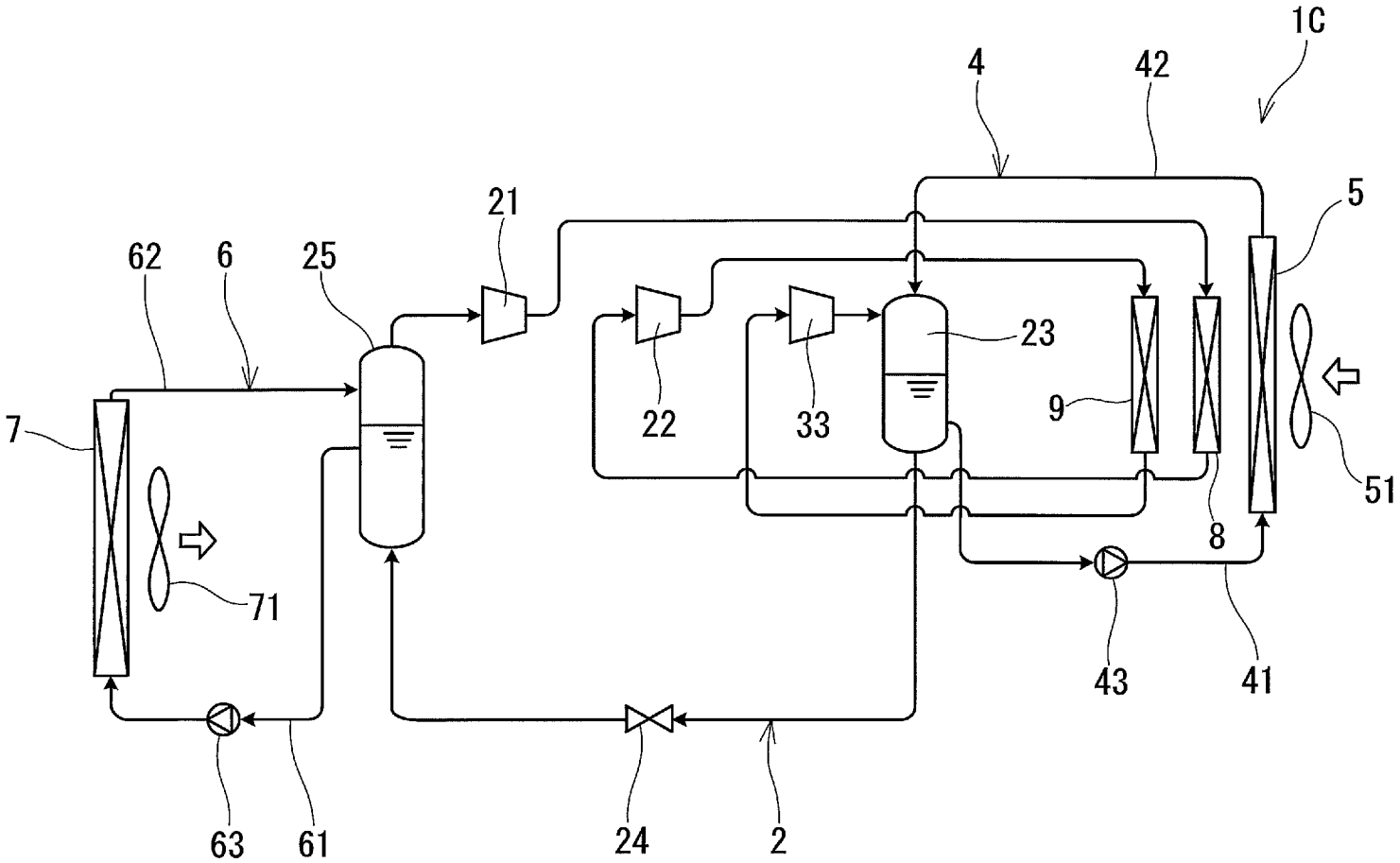
FIG. 11 is a configuration diagram of an air conditioner of still another modification of the third embodiment.

In still another modification, as shown in FIG. 11, the air conditioner 1C may include a third compressor 33 and a second vapor cooler 9. In the refrigerant circuit 2, the evaporator 25, the first compressor 21, the vapor cooler 8 (a first vapor cooler 8), the second compressor 22, the second vapor cooler 9, the third compressor 33, the condenser 23, and the expansion valve 24 are connected in this order.

The second vapor cooler 9 is a heat exchanger that exchanges heat between the refrigerant vapor compressed by the second compressor 22 and air, and cools the refrigerant vapor discharged from the second compressor 22 before the refrigerant vapor is drawn into the third compressor 33. In this modification, the second vapor cooler 9 is disposed indoors, like the first vapor cooler 8. As the second vapor cooler 9, for example, a fin-and-tube heat exchanger can be used.

More specifically, the second vapor cooler 9 is disposed in such a manner that a wind generated by the indoor fan 51 passes through the first heat exchanger 5 and then through the first vapor cooler 8 and the second vapor cooler 9 in this order. In other words, the first heat exchanger 5, the first vapor cooler 8, and the second vapor cooler 9 are arranged side by side in the direction of the air flow by the indoor fan 51, and the first vapor cooler 8 is located on the leeward side of the first heat exchanger 5 and the second vapor cooler 9 is located on the leeward side of the first vapor cooler 8. This configuration makes it possible to further enhance the heating capacity of the air conditioner 1C. The locations of the first vapor cooler 8 and the second vapor cooler 9 are not particularly limited.

Fourth Embodiment

Figure 12:
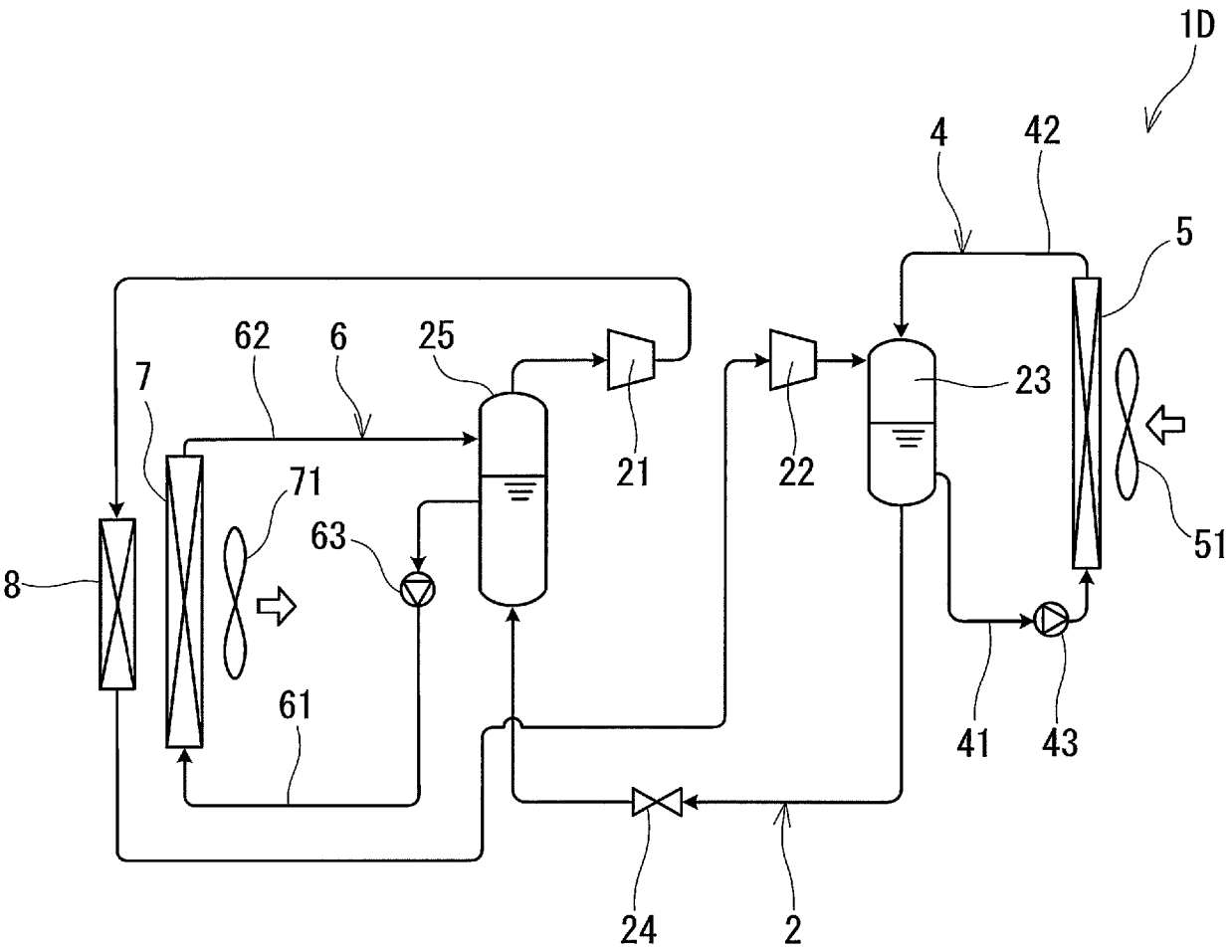
FIG. 12 is a configuration diagram of an air conditioner according to a fourth embodiment of the present invention.

FIG. 12 shows an air conditioner 1D according to the fourth embodiment of the present invention.

In the present embodiment, the vapor cooler 8 is disposed so as to heat the air to be supplied to the second heat exchanger 7. Specifically, the vapor cooler 8 is disposed in such a manner that a wind generated by an outdoor fan 71 passes through this vapor cooler 8 and then through the second heat exchanger 7. In other words, the vapor cooler 8 and the second heat exchanger 7 are arranged side by side in the direction of the air flow by the outdoor fan 71, and the vapor cooler 8 is located on the windward side of the second heat exchanger 7.

Next, how the air conditioner 1D works is described.

The refrigerant vapor compressed by the first compressor 21 releases heat to the outdoor air in the vapor cooler 8, and then is drawn into the second compressor 22. The refrigerant vapor further compressed by the second compressor 22 is condensed in the condenser 23 by heat exchange with the refrigerant liquid supercooled in the first heat exchanger 5. A portion of the refrigerant liquid resulting from the condensation in the condenser 23 is pumped to the first heat exchanger 5 by the pump 43. The refrigerant liquid pumped to the first heat exchanger 5 releases heat to the indoor air in the first heat exchanger 5, and then returns to the condenser 23.

The remaining portion of the refrigerant liquid resulting from the condensation in the condenser 23 is introduced into the evaporator 25 via the expansion valve 24. A portion of the refrigerant liquid in the evaporator 25 is pumped by the pump 63 to the second heat exchanger 7, absorbs heat from the outdoor air heated by the vapor cooler 8 in the second heat exchanger 7, and then returns to the evaporator 25. The refrigerant liquid in the evaporator 25 is evaporated by being boiled under a reduced pressure, and the refrigerant vapor resulting from the evaporation is drawn into the first compressor 21.

In the air conditioner 1D of the present embodiment, the heat released from the refrigerant vapor in the vapor cooler 8 can be recovered by the refrigerant liquid serving as a heat medium for cooling the outdoor air. Therefore, the heat loss in the heating operation is significantly reduced. Thereby, the COP of the air conditioner 1D can be improved.

In addition, since the air to be supplied to the second heat exchanger 7 is heated, it is possible to raise the temperature of the refrigerant liquid flowing from the second heat exchanger 7 and to increase the pressure of the refrigerant vapor in the evaporator 25. Thereby, the compression work of the first compressor 21 and the second compressor 22 also can be reduced.

Furthermore, in the present embodiment, the amount of frost formed on the second heat exchanger 7 in winter can be reduced. Therefore, the COP of the air conditioner 1D in winter can be improved particularly effectively, and the comfort level in the heating operation can be improved.

<Modification>

Various modifications can be made to the air conditioner 1D of the previously-described embodiment.

Figure 13:
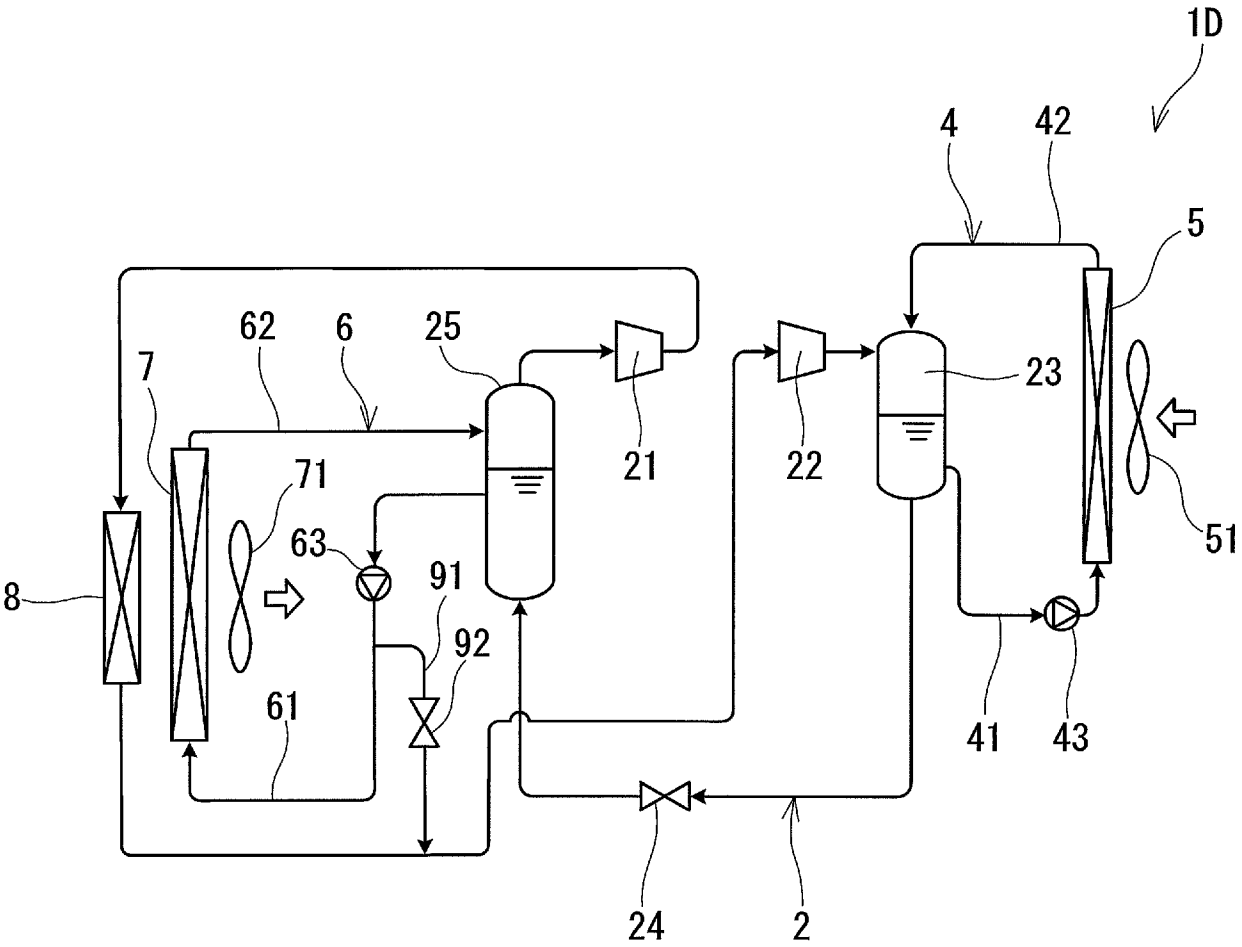
FIG. 13 is a configuration diagram of an air conditioner of a modification of the fourth embodiment.

For example, as shown in FIG. 13, the air conditioner 1D may include an injection passage 91 that injects the refrigerant liquid pumped from the pump 63 in the heat absorption side feed path 61 into a section of the refrigerant circuit 2 between the vapor cooler 8 and the second compressor 22. In this case, the injection is performed by means of pumping of the pump 63, as in the modification of the third embodiment. The injection passage 91 is provided with an injection valve 92 for regulating the injection flow rate.

In the case where the injection passage 91 is thus provided, the temperature of the refrigerant to be drawn into the second compressor 22 can be lowered, as in the modification of the third embodiment. Therefore, the reliability of the air conditioner 1D, in particular, the reliability of the second compressor 22 can be further improved.

Figure 14:
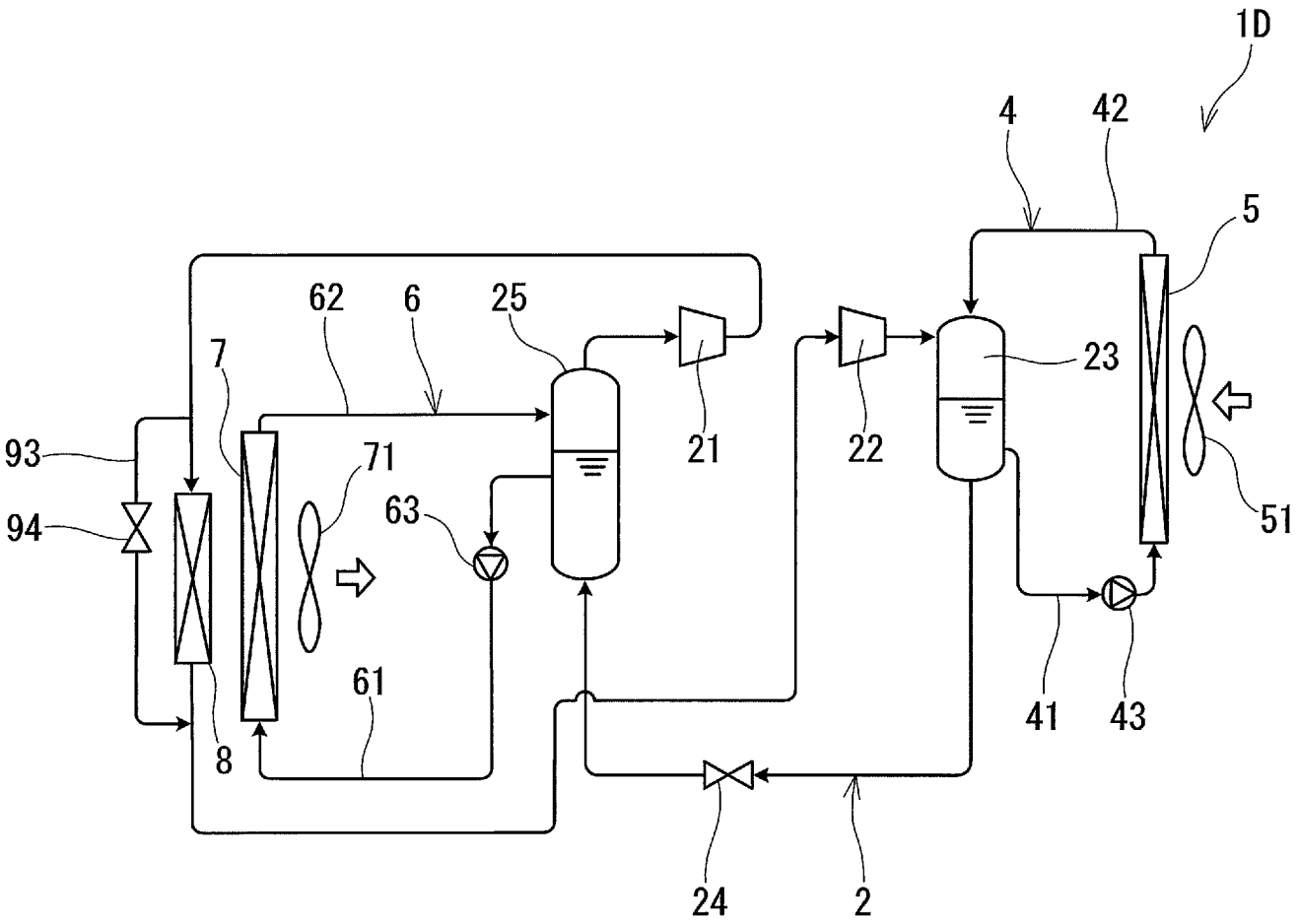
FIG. 14 is a configuration diagram of an air conditioner of another modification of the fourth embodiment.

As another modification, as shown in FIG. 14, the refrigerant circuit 2 may be provided with a bypass passage 93 that bypasses the vapor cooler 8. The bypass passage 93 is branched from the refrigerant circuit 2 at a position between the first compressor 21 and the vapor cooler 8 and is connected to the refrigerant circuit 2 at a position between the vapor cooler 8 and the second compressor 22. The bypass passage 93 is provided with a flow rate regulating valve (a flow rate regulating mechanism) 94.

In the case where the bypass passage 93 having the flow rate regulating valve 94 is thus provided, the amount of heat released from the refrigerant vapor between the first compressor 21 and the second compressor 22 can be optimally controlled, as in the modification of the third embodiment. In the case where a less amount of heat released from the refrigerant vapor is enough for the operation of the air conditioner 1D under certain conditions, the refrigerant liquid is allowed to flow preferentially in the bypass passage 93 so as to perform control of reducing the amount of released heat. Thus, the COP and comfort level of the air conditioner 1D are improved. The example of the method for controlling the flow rate regulating valve 94 is as described in the second embodiment.

Figure 15:
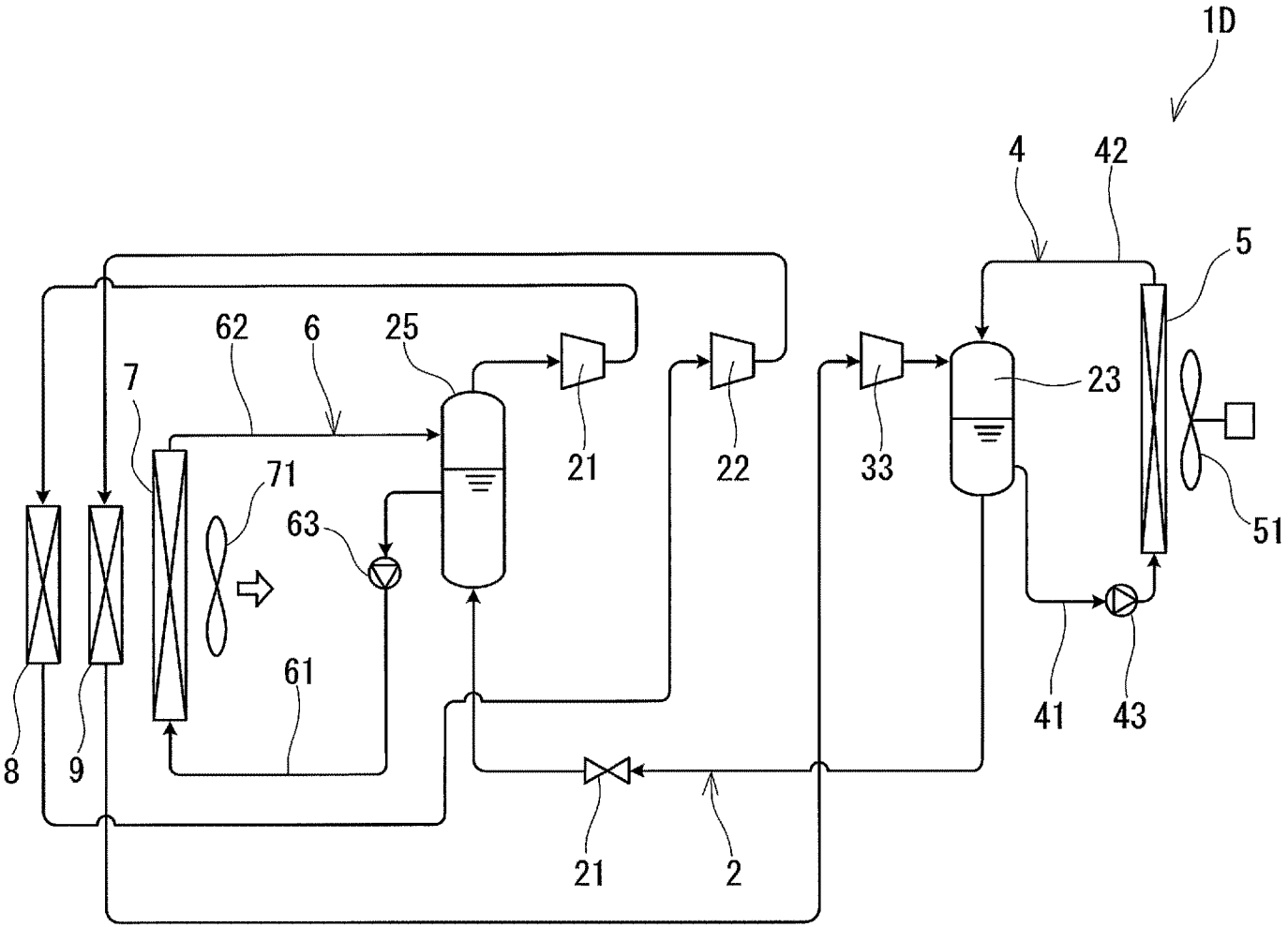
FIG. 15 is a configuration diagram of an air conditioner of still another modification of the fourth embodiment.

In still another modification, as shown in FIG. 15, the air conditioner 1D may include a third compressor 33 and a second vapor cooler 9. In the refrigerant circuit 2, the evaporator 25, the first compressor 21, the vapor cooler 8 (a first vapor cooler 8), the second compressor 22, the second vapor cooler 9, the third compressor 33, the condenser 23, and the expansion valve 24 are connected in this order.

The second vapor cooler 9 is a heat exchanger that exchanges heat between the refrigerant vapor compressed by the second compressor 22 and air, and cools the refrigerant vapor discharged from the second compressor 22 before the refrigerant vapor is drawn into the third compressor 33. In this modification, the second vapor cooler 9 is disposed outdoors, like the first vapor cooler 8. As the second vapor cooler 9, for example, a fin-and-tube heat exchanger can be used.

More specifically, the first vapor cooler 8 and the second vapor cooler 9 are disposed on the windward side of the second heat exchanger 7. The first vapor cooler 8 and the second vapor cooler 9 are disposed in such a manner that a wind generated by the outdoor fan 71 passes through the first vapor cooler 8, the second vapor cooler 9, and the second heat exchanger 7 in this order. In other words, the second heat exchanger 7, the first vapor cooler 8, and the second vapor cooler 9 are arranged side by side in the direction of the air flow by the outdoor fan 71, and the second vapor cooler 9 is located on the leeward side of the first vapor cooler 8 and the second heat exchanger 7 is located on the leeward side of the second vapor cooler 9. This configuration makes it possible to cool the refrigerant vapor efficiently. The locations of the first vapor cooler 8 and the second vapor cooler 9 are not particularly limited.

Figure 16:
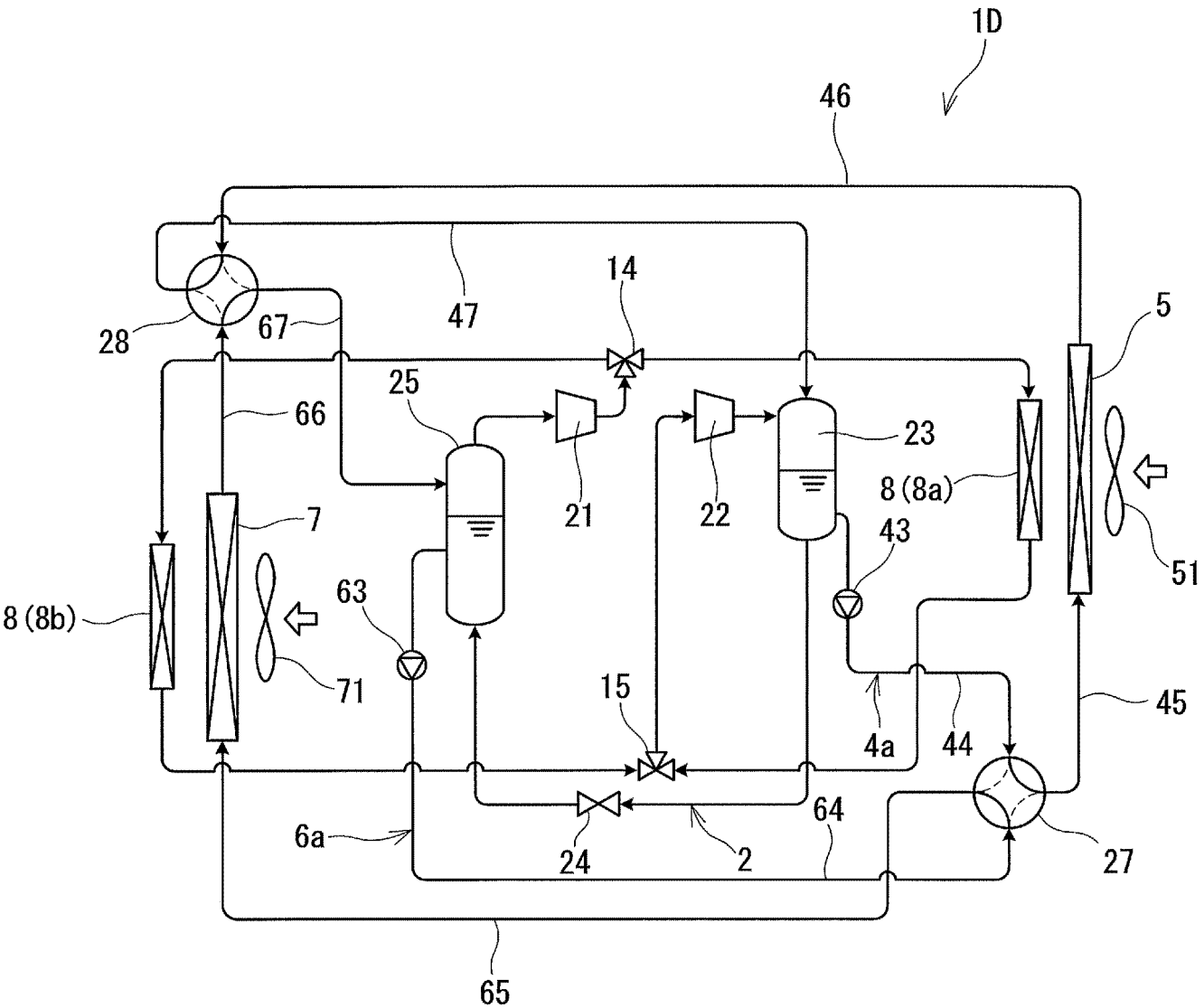
FIG. 16 is a configuration diagram of an air conditioner of still another modification of the fourth embodiment.

As shown in FIG. 16, in still another modification, the air conditioner 1D includes a first circulation path 4*a*, a second circulation path 6*a*, a first switching valve 27, a second switching valve 28, a third switching valve 14, and a fourth switching valve 15. The structures, functions, locations, etc. of the first circulation path 4*a*, the second circulation path 6*a*, the first switching valve 27, and the second switching valve 28 are as described above with reference to FIG. 4.

The air conditioner 1D further includes two vapor coolers 8 (8*a*, 8*b*). The vapor coolers 8*a* and 8*b* are both heat exchangers that exchange heat between the refrigerant vapor compressed by the first compressor 21 and air, and cool the refrigerant vapor discharged from the first compressor 21 before the refrigerant vapor is drawn into the second compressor 22. The vapor cooler 8*a* (an indoor side vapor cooler 8*a*) is disposed indoors, and the vapor cooler 8*b* (an outdoor side vapor cooler 8*b*) is disposed outdoors.

The third switching valve 14 and the fourth switching valve 15 are controlled so that the refrigerant vapor is allowed to pass through only one selected from the vapor coolers 8*a* and 8*b*. A specific example of each of the third switching valve 14 and the fourth switching valve 15 is a three-way valve. In the heating operation, the third switching valve 14 and the fourth switching valve 15 are controlled so that the refrigerant vapor is allowed to pass through the vapor cooler 8*a*. In the cooling operation, the third switching valve 14 and the fourth switching valve 15 are controlled so that the refrigerant vapor is allowed to pass through the vapor cooler 8*b*. This configuration makes it possible to cool the refrigerant vapor compressed by the first compressor 21 reliably when the operation is switched between heating and cooling.

The structure, function, location, etc. of the vapor cooler 8*a* are as described above with reference to FIG. 8. The structure, function, location, etc. of the vapor cooler 8*b* are as described above with reference to FIG. 12. When the refrigerant vapor flows through the vapor cooler 8*b*, the refrigerant liquid is fed from the condenser 23 to the second heat exchanger 7. Therefore, the vapor cooler 8*b* can be disposed so as to further heat the air heated in the second heat exchanger 7. Specifically, the vapor cooler 8*b* is disposed in such a manner that a wind generated by the outdoor fan 71 passes through the second heat exchanger 7 and then through the vapor cooler 8*b*. In other words, the vapor cooler 8*b* and the second heat exchanger 7 are arranged side by side in the direction of the air flow by the outdoor fan 71, and the vapor cooler 8*b* is located on the leeward side of the second heat exchanger 7.

Other Embodiments

In each of previously-described embodiments, the heat release circuit 4 and the heat absorption circuit 6 are each a circuit that merges into the refrigerant circuit 2 to bring the heat medium into direct contact with the refrigerant. However, the heat release circuit 4 and the heat absorption circuit 6 may each be a circuit that brings a heat transfer medium into indirect contact with the refrigerant without merging into the refrigerant circuit 2. That is, the heat release circuit 4 may have a flow path for heat exchange provided in the condenser 23, and the heat absorption circuit 6 may have a flow path for heat exchange provided in the condenser 25.

In addition, the air conditioner of the present invention may be configured in any manner as long as it can perform at least heating operation, and the second heat exchanger 7 may be, for example, a heat exchanger that absorbs heat from a liquid.

INDUSTRIAL APPLICABILITY

The refrigeration apparatus of the present invention is useful for air conditioners, chillers, heat storage devices, etc., and is particularly useful for household air conditioners, industrial air conditioners, etc.

The invention claimed is:

1. A refrigeration apparatus, comprising:

a refrigerant circuit that allows a refrigerant to circulate, the refrigerant circuit comprising an evaporator that retains a refrigerant liquid and that evaporates the refrigerant liquid therein, a first compressor that compresses a refrigerant vapor, a vapor cooler that cools the refrigerant vapor, a second compressor that compresses the refrigerant vapor, and a condenser that condenses the refrigerant vapor therein and that retains the refrigerant liquid, wherein the evaporator, the first compressor, the vapor cooler, the second compressor, and the condenser are present in the refrigerant circuit in this order, in the refrigerant circuit the refrigerant flowing (a) from the evaporator to the first compressor, (b) from the first compressor to the vapor cooler, (c) from the vapor cooler to the second compressor, and (d) from the second compressor before returning to the evaporator;

a heat release circuit that allows the refrigerant to circulate between the condenser and a first heat exchanger that releases heat to the atmosphere; and a heat absorption circuit that allows the refrigerant to circulate between the evaporator and a second heat exchanger, wherein the heat release circuit comprises a heat release side feed path that feeds the refrigerant from the condenser to the first heat exchanger, and a heat release side return path that returns the refrigerant from the first heat exchanger to the condenser, and the vapor cooler is a heat exchanger that exchanges heat between the refrigerant vapor compressed by the first compressor and the refrigerant flowing in the heat release side feed path of the heat release circuit.

2. The refrigeration apparatus according to claim 1, wherein the refrigerant circulating in the heat release circuit is the refrigerant liquid retained in the condenser, the heat release side feed path is provided with a pump, and the vapor cooler is disposed on the heat release side feed path.

3. The refrigeration apparatus according to claim 1, wherein the refrigerant circulating in the heat absorption circuit is the refrigerant liquid retained in the evaporator, the heat absorption circuit comprises a heat absorption side feed path that feeds the refrigerant liquid from the evaporator to the second heat exchanger and that is provided with a pump, and a heat absorption side return path that returns the refrigerant liquid from the second heat exchanger to the evaporator, and the refrigeration apparatus further comprises an injection passage that injects the refrigerant liquid pumped from the pump in the heat absorption side feed path into a section of the refrigerant circuit between the vapor cooler and the second compressor.

4. The refrigeration apparatus according to claim 2, wherein the heat release side feed path is provided with a bypass passage that bypasses the vapor cooler, and the bypass passage is provided with a flow rate regulating mechanism.

5. The refrigeration apparatus according to claim 1, wherein the second heat exchanger is a heat exchanger that absorbs heat from the atmosphere.

* * * * *